US008899352B2

(12) United States Patent
Johnson et al.

(10) Patent No.: US 8,899,352 B2
(45) **Date of Patent: *Dec. 2, 2014**

(54) SYSTEM AND METHOD FOR DRILLING

(75) Inventors: Ashley Johnson, Cambridgeshire (GB); Walter David Aldred, Hertfordshire (GB); Geoffrey Downton, Sugar Land, TX (US); Riadh Boualleg, Cambridge (GB); Kjell Haugvaldstad, Vanvikan (NO); Michael Sheppard, Cambridgeshire (GB)

(73) Assignee: Schlumberger Technology Corporation, Cambridge, MA (US)

( * ) Notice: Subject to any disclaimer, the term of this patent is extended or adjusted under 35 U.S.C. 154(b) by 709 days.

This patent is subject to a terminal disclaimer.

(21) Appl. No.: 12/370,890

(22) Filed: Feb. 13, 2009

(65) Prior Publication Data

US 2009/0188720 A1 Jul. 30, 2009

Related U.S. Application Data

(63) Continuation-in-part of application No. 11/839,381, filed on Aug. 15, 2007, now Pat. No. 8,757,294.

(51) Int. Cl.
*E21B 7/08* (2006.01)
*E21B 7/04* (2006.01)
*E21B 7/06* (2006.01)

(52) U.S. Cl.
CPC ..... *E21B 7/06* (2013.01)
USPC ..... 175/263; 175/266; 175/285; 175/73; 175/24; 175/55; 175/61

(58) Field of Classification Search
USPC ..... 175/263, 266, 285, 73, 24, 55, 61
See application file for complete search history.

(56) References Cited

U.S. PATENT DOCUMENTS 1,156,147 A 10/1915 Karns
1,638,337 A 8/1927 Hutton
(Continued)

FOREIGN PATENT DOCUMENTS

BE 1012545 A3 12/2000
EP 0530045 A1 3/1993
(Continued)

OTHER PUBLICATIONS

Anonymous, "geostationary," Dictionary definition accessed and retrieved Feb. 24, 2012 from the Free Online Dictionary, p. 1, <http://www.thefreedictionary.com/geostationary>.

*Primary Examiner* — James Sayre
(74) *Attorney, Agent, or Firm* — Steven Gahlings

(57) ABSTRACT

This disclosure relates in general to a method and system for controlling a drilling system for drilling a borehole in an earth formation. More specifically, but not by way of limitation, embodiments of the present invention provide systems and methods for controlling dynamic interactions between the drilling system for drilling the borehole and an inner surface of the borehole being drilled to steer the drilling system to directionally drill the borehole. In another embodiment of the present invention, data regarding the functioning of the drilling system as it drills the borehole may be sensed and interactions between the drilling system for drilling the borehole and an inner surface of the borehole may be controlled in response to the sensed data to control the drilling system as the borehole is being drilled.

23 Claims, 17 Drawing Sheets

GAUGE PAD ASSEMBLY WITH CUTTER PROFILE.

(56) References Cited

U.S. PATENT DOCUMENTS

| | | | | |
|---|---|---|---|---|
| 1,667,155 | A | 4/1928 | Higdon | |
| 2,010,789 | A | 8/1935 | Roesel | |
| 2,016,042 | A | 10/1935 | Lewis | |
| 2,238,377 | A | 4/1941 | Strang | |
| 2,670,046 | A | 2/1954 | Kinzbach | |
| 3,224,513 | A | 12/1965 | Weeden, Jr. | |
| 3,285,349 | A | 11/1966 | Brandon | |
| 4,190,123 | A | 2/1980 | Roddy | |
| 4,211,292 | A | 7/1980 | Evans | |
| 4,319,649 | A | 3/1982 | Jeter | |
| 4,394,193 | A | 7/1983 | Gfrerer | |
| 4,690,229 | A | 9/1987 | Raney | |
| 4,739,843 | A | 4/1988 | Burton | |
| 4,775,017 | A | 10/1988 | Forrest et al. | |
| 4,807,708 | A | 2/1989 | Forrest et al. | |
| 4,842,083 | A | 6/1989 | Raney | |
| 4,856,601 | A | 8/1989 | Raney | |
| 5,010,789 | A | 4/1991 | Brett et al. | |
| 5,042,596 | A | 8/1991 | Brett et al. | |
| 5,090,492 | A | 2/1992 | Keith | |
| 5,113,953 | A | 5/1992 | Noble | |
| 5,159,577 | A | 10/1992 | Twist | |
| 5,163,524 | A | 11/1992 | Newton, Jr. et al. | |
| 5,213,168 | A | 5/1993 | Warren et al. | |
| 5,265,682 | A | 11/1993 | Russell et al. | |
| 5,339,910 | A | 8/1994 | Mueller | |
| 5,341,886 | A | 8/1994 | Patton | |
| 5,343,964 | A | 9/1994 | Leroy | |
| 5,361,859 | A | 11/1994 | Tibbitts | |
| 5,423,389 | A | 6/1995 | Warren et al. | |
| 5,490,569 | A | 2/1996 | Brotherton et al. | |
| 5,520,255 | A | 5/1996 | Barr et al. | |
| 5,553,678 | A * | 9/1996 | Barr et al. | 175/73 |
| 5,553,679 | A | 9/1996 | Thorp | |
| 5,560,440 | A | 10/1996 | Tibbitts | |
| 5,582,259 | A | 12/1996 | Barr | |
| 5,603,385 | A | 2/1997 | Colebrook | |
| 5,641,421 | A | 6/1997 | Manov et al. | |
| 5,649,604 | A | 7/1997 | Fuller et al. | |
| 5,651,421 | A | 7/1997 | Newton et al. | |
| 5,673,763 | A | 10/1997 | Thorp | |
| 5,685,379 | A | 11/1997 | Barr et al. | |
| 5,695,015 | A | 12/1997 | Barr et al. | |
| 5,697,461 | A | 12/1997 | Newton et al. | |
| 5,706,905 | A | 1/1998 | Barr | |
| 5,778,992 | A * | 7/1998 | Fuller | 175/73 |
| 5,803,185 | A | 9/1998 | Barr et al. | |
| 5,803,196 | A | 9/1998 | Fielder | |
| 5,836,406 | A | 11/1998 | Schuh | |
| 5,971,085 | A | 10/1999 | Colebrook | |
| 5,979,577 | A | 11/1999 | Fielder | |
| 6,089,332 | A | 7/2000 | Barr et al. | |
| 6,092,610 | A | 7/2000 | Kosmala et al. | |
| 6,142,250 | A | 11/2000 | Griffin et al. | |
| 6,158,529 | A | 12/2000 | Dorel | |
| 6,244,361 | B1 | 6/2001 | Comeau et al. | |
| 6,257,356 | B1 | 7/2001 | Wassell | |
| 6,290,007 | B2 | 9/2001 | Beuershausen et al. | |
| 6,360,831 | B1 | 3/2002 | Akesson et al. | |
| 6,364,034 | B1 | 4/2002 | Schoeffler | |
| 6,394,193 | B1 | 5/2002 | Askew | |
| 6,427,792 | B1 | 8/2002 | Roberts et al. | |
| 6,601,658 | B1 | 8/2003 | Downton | |
| 6,604,658 | B1 | 8/2003 | Young et al. | |
| 6,629,476 | B2 | 10/2003 | Fielder et al. | |
| 6,904,984 | B1 | 6/2005 | Estes et al. | |
| 6,971,459 | B2 | 12/2005 | Raney | |
| 7,090,037 | B2 | 8/2006 | Best | |
| 7,201,237 | B2 | 4/2007 | Raney | |
| 7,287,604 | B2 * | 10/2007 | Aronstam et al. | 175/61 |
| 7,308,955 | B2 | 12/2007 | Barton et al. | |
| 7,757,784 | B2 | 7/2010 | Fincher et al. | |
| 7,762,356 | B2 | 7/2010 | Turner et al. | |
| 7,845,430 | B2 | 12/2010 | Johnson et al. | |
| 7,971,661 | B2 | 7/2011 | Johnson et al. | |
| 7,971,662 | B2 | 7/2011 | Beuershausen | |
| 8,066,085 | B2 | 11/2011 | Johnson et al. | |
| 8,087,479 | B2 | 1/2012 | Kulkarni et al. | |
| 8,550,185 | B2 | 10/2013 | Johnson et al. | |
| 2001/0052428 | A1 | 12/2001 | Larronde et al. | |
| 2002/0011359 | A1 | 1/2002 | Webb et al. | |
| 2002/0020565 | A1 | 2/2002 | Hart et al. | |
| 2002/0053470 | A1 | 5/2002 | Noe et al. | |
| 2002/0088649 | A1 | 7/2002 | Morris, Sr. et al. | |
| 2002/0100617 | A1 | 8/2002 | Watson et al. | |
| 2003/0056991 | A1 | 3/2003 | Hahn et al. | |
| 2004/0216921 | A1 | 11/2004 | Krueger | |
| 2005/0020565 | A1 | 1/2005 | Jones et al. | |
| 2005/0056463 | A1 | 3/2005 | Aronstam et al. | |
| 2005/0236187 | A1 | 10/2005 | Chen et al. | |
| 2005/0269082 | A1 | 12/2005 | Baron et al. | |
| 2006/0090935 | A1 | 5/2006 | van Steenwyk et al. | |
| 2006/0157277 | A1 | 7/2006 | Bittar et al. | |
| 2006/0196697 | A1 | 9/2006 | Raney | |
| 2006/0237234 | A1 | 10/2006 | Dennis et al. | |
| 2006/0249287 | A1 | 11/2006 | Downton et al. | |
| 2007/0007000 | A1 | 1/2007 | Dewey et al. | |
| 2007/0205022 | A1 | 9/2007 | Treviranus et al. | |
| 2007/0272445 | A1 * | 11/2007 | Cariveau et al. | 175/331 |
| 2008/0000693 | A1 | 1/2008 | Hutton | |
| 2008/0115974 | A1 | 5/2008 | Johnson et al. | |
| 2009/0044977 | A1 | 2/2009 | Johnson et al. | |
| 2009/0044979 | A1 | 2/2009 | Johnson et al. | |
| 2009/0044980 | A1 | 2/2009 | Sheppard et al. | |
| 2009/0044981 | A1 | 2/2009 | Sheppard et al. | |
| 2009/0065262 | A1 | 3/2009 | Downton et al. | |
| 2009/0194334 | A1 | 8/2009 | Johnson et al. | |
| 2010/0038141 | A1 | 2/2010 | Johnson et al. | |
| 2012/0018224 | A1 | 1/2012 | Johnson et al. | |

FOREIGN PATENT DOCUMENTS

| | | | |
|---|---|---|---|
| EP | 0707131 | A2 | 4/1996 |
| EP | 0707131 | A3 | 10/1996 |
| EP | 1227214 | A2 | 7/2002 |
| EP | 1227214 | A3 | 3/2003 |
| GB | 2257182 | A | 1/1993 |
| GB | 2285651 | A | 7/1995 |
| GB | 2304759 | A | 3/1997 |
| GB | 2343470 | A | 5/2000 |
| GB | 2355744 | A | 5/2001 |
| GB | 2367626 | | 4/2002 |
| GB | 2367626 | A | 4/2002 |
| GB | 2408526 | A | 8/2006 |
| GB | 2423102 | A | 8/2006 |
| GB | 2423546 | A | 8/2006 |
| GB | 2425790 | A | 11/2006 |
| GB | 2439661 | A | 1/2008 |
| RU | 2006560 | | 1/1994 |
| RU | 2029047 | | 2/1995 |
| RU | 2100559 | | 12/1997 |
| RU | 2239042 | | 10/2004 |
| RU | 2006100565 | | 7/2007 |
| WO | 9619635 | A1 | 6/1996 |
| WO | 9747848 | A1 | 12/1997 |
| WO | 9815710 | A1 | 4/1998 |
| WO | 9928587 | A1 | 6/1999 |
| WO | 0121927 | A2 | 3/2001 |
| WO | 0236924 | A2 | 5/2002 |
| WO | 03/004824 | A1 | 1/2003 |
| WO | 03052237 | A1 | 6/2003 |
| WO | 03/097989 | A1 | 11/2003 |
| WO | 2004104360 | A2 | 12/2004 |
| WO | 2004113664 | A1 | 12/2004 |
| WO | 2006012186 | A1 | 2/2006 |
| WO | 2007012858 | A1 | 2/2007 |
| WO | 2007036722 | | 4/2007 |

* cited by examiner

PAD IN BIT

PAD IN FLANK OF BIT

PAD BEHIND BIT

GAUGE PAD ASSEMBLY WITH CUTTER PROFILE.

SYSTEM AND METHOD FOR DRILLING

CROSS-REFERENCES TO RELATED APPLICATIONS

This application is a continuation-in-part of U.S. patent application Ser. No. 11/839,381 filed Aug. 15, 2007, the entire content of which is incorporated herein by reference for all purposes.

BACKGROUND

This disclosure relates in general to a method and a system for controlling a drilling system for drilling a borehole in an earth formation. More specifically, but not by way of limitation, in one embodiment of the present invention a system and method is provided for controlling interactions between the drilling system for drilling the borehole and an inner surface of the borehole being drilled by the drilling system to provide for steering the drilling system to directionally drill a borehole through the earth formation. In certain aspects of the present invention, the drilling system may be controlled to provide that the borehole reaches a target objective.

In another embodiment of the present invention, data regarding the functioning of the drilling system as it drills the borehole may be sensed and interactions between the drilling system for drilling the borehole and the inner surface of the borehole may be controlled in response to the sensed data to provide for controlling operation of the drilling system. In certain aspects, interactions between the drilling system and the inner surface may be controlled to provide for controlling the interaction of the drill bit with the earth formation.

In many industries, it is often desirable to directionally drill a borehole through an earth formation or core a hole in sub-surface formations in order that the borehole and/or coring may circumvent and/or pass through deposits and/or reservoirs in the formation to reach a predefined objective in the formation and/or the like. When drilling or coring holes in sub-surface formations, it is sometimes desirable to be able to vary and control the direction of drilling, for example to direct the borehole towards a desired target, or control the direction horizontally within an area containing hydrocarbons once the target has been reached. It may also be desirable to correct for deviations from the desired direction when drilling a straight hole, or to control the direction of the hole to avoid obstacles.

In the hydrocarbon industry for example, a borehole may be drilled so as to intercept a particular subterranean-formation at a particular location. In some drilling processes, to drill the desired borehole, a drilling trajectory through the earth formation may be pre-planned and the drilling system may be controlled to conform to the trajectory. In other processes, or in combination with the previous process, an objective for the borehole may be determined and the progress of the borehole being drilled in the earth formation may be monitored during the drilling process and steps may be taken to ensure the borehole attains the target objective. Furthermore, operation of the drill system may be controlled to provide for economic drilling, which may comprise drilling so as to bore through the earth formation as quickly as possible, drilling so as to reduce bit wear, drilling so as to achieve optimal drilling through the earth formation and optimal bit wear and/or the like.

One aspect of drilling is called "directional drilling." Directional drilling is the intentional deviation of the borehole/wellbore from the path it would naturally take. In other words, directional drilling is the steering of the drill string so that it travels in a desired direction.

Directional drilling is advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

The monitoring process for directional drilling of the borehole may include determining the location of the drill bit in the earth formation, determining an orientation of the drill bit in the earth formation, determining a weight-on-bit of the drilling system, determining a speed of drilling through the earth formation, determining properties of the earth formation being drilled, determining properties of a subterranean formation surrounding the drill bit, looking forward to ascertain properties of formations ahead of the drill bit, seismic analysis of the earth formation, determining properties of reservoirs etc. proximal to the drill bit, measuring pressure, temperature and/or the like in the borehole and/or surrounding the borehole and/or the like. In any process for directional drilling of a borehole, whether following a pre-planned trajectory, monitoring the drilling process and/or the drilling conditions and/or the like, it is necessary to be able to steer the drilling system.

Forces which act on the drill bit during a drilling operation include gravity, torque developed by the bit, the end load applied to the bit, and the bending moment from the drill assembly. These forces together with the type of strata being drilled and the inclination of the strata to the bore hole may create a complex interactive system of forces during the drilling process.

The drilling system may comprise a "rotary drilling" system in which a downhole assembly, including a drill bit, is connected to a drill-string that may be driven/rotated from the drilling platform. In a rotary drilling system directional drilling of the borehole may be provided by varying factors such as weight-on-bit, the rotation speed, etc.

With regards to rotary drilling, known methods of directional drilling include the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling.

Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottomhole assembly ("BHA") in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottomhole assembly close to the lower stabilizer or a flexure of the drill bit drive shaft distributed between the upper and lower stabilizer.

Pointing the bit may comprise using a downhole motor to rotate the drill bit, the motor and drill bit being mounted upon a drill string that includes an angled bend. In such a system, the drill bit may be coupled to the motor by a hinge-type or tilted mechanism/joint, a bent sub or the like, wherein the drill bit may be inclined relative to the motor. When variation of the direction of drilling is required, the rotation of the drill-string may be stopped and the bit may be positioned in the borehole, using the downhole motor, in the required direction and rotation of the drill bit may start the drilling in the desired direction. In such an arrangement, the direction of drilling is dependent upon the angular position of the drill string.

In its idealized form, in a pointing the bit system, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference.

Push the bit systems and methods make use of application of force against the borehole wall to bend the drill-string and/or force the drill bit to drill in a preferred direction. In a push-the-bit rotary steerable system, the requisite non-collinear condition is achieved by causing a mechanism to apply a force or create displacement in a direction that is preferentially orientated with respect to the direction of hole propagation. There are many ways in which this may be achieved, including non-rotating (with respect to the hole), displacement based approaches and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

Known forms of RSS are provided with a "counter rotating" mechanism which rotates in the opposite direction of the drill string rotation. Typically, the counter rotation occurs at the same speed as the drill string rotation so that the counter rotating section maintains the same angular position relative to the inside of the borehole. Because the counter rotating section does not rotate with respect to the borehole, it is often called "geostationary" by those skilled in the art. In this disclosure, no distinction is made between the terms "counter rotating" and "geo-stationary."

A push-the-bit system typically uses either an internal or an external counter-rotation stabilizer. The counter-rotation stabilizer remains at a fixed angle (or geo-stationary) with respect to the borehole wall. When the borehole is to be deviated, an actuator presses a pad against the borehole wall in the opposite direction from the desired deviation. The result is that the drill bit is pushed in the desired direction.

The force generated by the actuators/pads is balanced by the force to bend the bottomhole assembly, and the force is reacted through the actuators/pads on the opposite side of the bottomhole assembly and the reaction force acts on the cutters of the drill bit, thus steering the hole. In some situations, the force from the pads/actuators may be large enough to erode the formation where the system is applied.

For example, the Schlumberger Powerdrive system uses three pads arranged around a section of the bottomhole assembly to be synchronously deployed from the bottomhole assembly to push the bit in a direction and steer the borehole being drilled. In the system, the pads are mounted close, in a range of 1-4 ft behind the bit and are powered/actuated by a stream of mud taken from the circulation fluid. In other systems, the weight-on-bit provided by the drilling system or a wedge or the like may be used to orient the drilling system in the borehole.

While system and methods for applying a force against the borehole wall and using reaction forces to push the drill bit in a certain direction or displacement of the bit to drill in a desired direction may be used with drilling systems including a rotary drilling system, the systems and methods may have disadvantages. For example such systems and methods may require application of large forces on the borehole wall to bend the drill-string and/or orient the drill bit in the borehole; such forces may be of the order of 5 kN or more, that may require large/complicated downhole motors or the like to be generated. Additionally, many systems and methods may use repeatedly thrusting of pads/actuator outwards into the borehole wall as the bottomhole assembly rotates to generate the reaction forces to push the drill bit, which may require complex/expensive/high maintenance synchronizing systems, complex control systems and/or the like.

BRIEF SUMMARY

This disclosure relates in general to a method and system for controlling a drilling system configured for drilling or coring a borehole through a subterranean formation. More specifically, but not by way of limitation, embodiments of the present invention provide for using drilling noise, i.e. the unsteady motion of the drilling system in the borehole during the drilling process and interactions between the drilling system and an inner surface of the borehole resulting from the unsteady motion of the drilling system to control the drilling system and/or the drilling process.

As such, embodiments of the present invention provide for controlling repeated interactions between the drilling system and the inner surface of the borehole during the drilling process and using the control of the repeated interactions between the drilling system and the inner surface to control operation/functioning of the drilling system. In some embodiments, the repeated interactions between one or more sections of the drilling system and the inner surface of the borehole may be controlled to provide for steering the drilling system to directionally drill the borehole. In other embodiments, the repeated interactions between one or more sections of the drilling system and the inner surface of the borehole may be controlled to provide for controlling operation of the drilling system, such as controlling operation of the drill bit during the drilling process.

As such, in one embodiment of the present invention, a method for steering a drilling system configured for drilling a borehole in an earth formation is provided, the method comprising:

- controlling dynamic interactions between a section of the drilling system and an inner surface of said borehole; and
- using the controlled dynamic interactions between the section of the drilling system and the inner surface of said borehole to control the drilling system.

In certain aspects, the step of controlling dynamic interactions between a section of the drilling system and an inner surface of said borehole comprises providing that the dynamic interactions between the section of the drilling system and the inner wall are non-uniform. Moreover, the step of controlling dynamic interactions between a section of the drilling system and an inner surface of said borehole may comprise providing that the interactions between the section of the drilling system and the inner surface vary circumferentially around the section of the drilling system.

In rotary drilling systems, the section of the drilling system providing for the control of the dynamic interactions may be maintained geostationary in the borehole during operation of the drilling system. In certain embodiments, the dynamic interactions may be controlled so as to provide for steering the drilling system. In other embodiments, the dynamic interactions may be controlled so as to provide for controlling the drill bit.

In some embodiments of the present invention, controlling dynamic interaction between at least a section of the drilling system and the inner surface of said borehole may comprise coupling a contact element with the drilling system and using the contact element to control the dynamic interaction. In a rotary drilling system the contact element may be held geostationary in the borehole during operation of the drilling system.

In certain aspects of the present invention, the contact element is configured to produce a non-uniform dynamic interaction with the inner surface. In such aspects, the contact element may be asymmetrically shaped, may be configured to have a non-uniform compliance, may comprise a cylinder that is eccentrically coupled with the bottomhole assembly, may comprise an element with a non-uniform weight distribution and/or the like.

In some embodiments, the contact element may comprise an extendable member that may be extended outwards from the drilling system towards and/or into contact with the inner surface. The extendable element may be used to apply a force to the inner surface to control the dynamic interactions. The force applied to the inner surface may be less than 1 kN.

In certain aspects, the contact element may be coupled with the drilling system so as to provide that the contact element is disposed within a cutting silhouette of the drill bit. In other aspects, the contact element may be coupled with the drilling system so as to provide that at least a portion of the contact element is disposed outside the cutting silhouette of the drill bit.

In some embodiments of the present invention, a driver may be used to alter/control the dynamic motion of the drilling system during a drilling procedure. In some embodiments of the present invention, a processor may be used to manage the system for controlling the dynamic interactions between the drilling system and the inner surface. Managing the system for controlling the dynamic interactions between the drilling system and the inner surface may comprise positioning the system on the drilling system and/or moving the system on the drilling system. In certain aspects the managing processor may receive data from sensors regarding the drilling process, operation of the drilling system and/or components of the drilling system, positions of the drilling system and/or components of the drilling system, location of an objective for the borehole in the earth formation, conditions in the borehole, properties of the earth formation and/or parts of the earth formation in the process of being drilled, properties of the dynamic motion of the drilling system and/or different sections of the drilling system and/or the like.

In some embodiments of the present invention, control of the dynamic interactions between the drilling system and the inner surface of the borehole being drilled may be provided by altering a profile of the inner-wall of the borehole being drilled. In certain aspects, a device such as an asymmetric drilling bit, a secondary drilling bit, an extendable element that extends from the drilling system to the inner-wall, an electro-pulse drill bit, a jetting device and/or the like may be controlled to provide that the inner-wall has a non-uniform profile so as to provide for controlling the dynamic interactions between the drilling system and the inner-wall.

In embodiments of the present invention, the system or method for controlling the dynamic interactions between the drilling system and the inner surface of the borehole being drilled may be controlled in real-time to provide for real-time control of the drilling system. The configurations of the dynamic interaction controller may be determined theoretically, experimentally, by modeling of the dynamic interactions, from experience with previous drilling processes and/or the like. In certain aspects, the dynamic interaction controller may comprise a contact element positioned less than 10 feet from the drill bit, may comprise a contact element disposed with an outer-surface less than millimeters inside the drilling silhouette of the drill bit, may comprise a contact element disposed with an outer-surface that extends, at least in part, of the order of millimeters outside the drilling silhouette of the drill bit.

BRIEF DESCRIPTION OF THE DRAWINGS

In the figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

The invention will be better understood in the light of the following description of non-limiting and illustrative embodiments, given with reference to the accompanying drawings, in which.

DETAILED DESCRIPTION OF THE INVENTION

Figure 1:
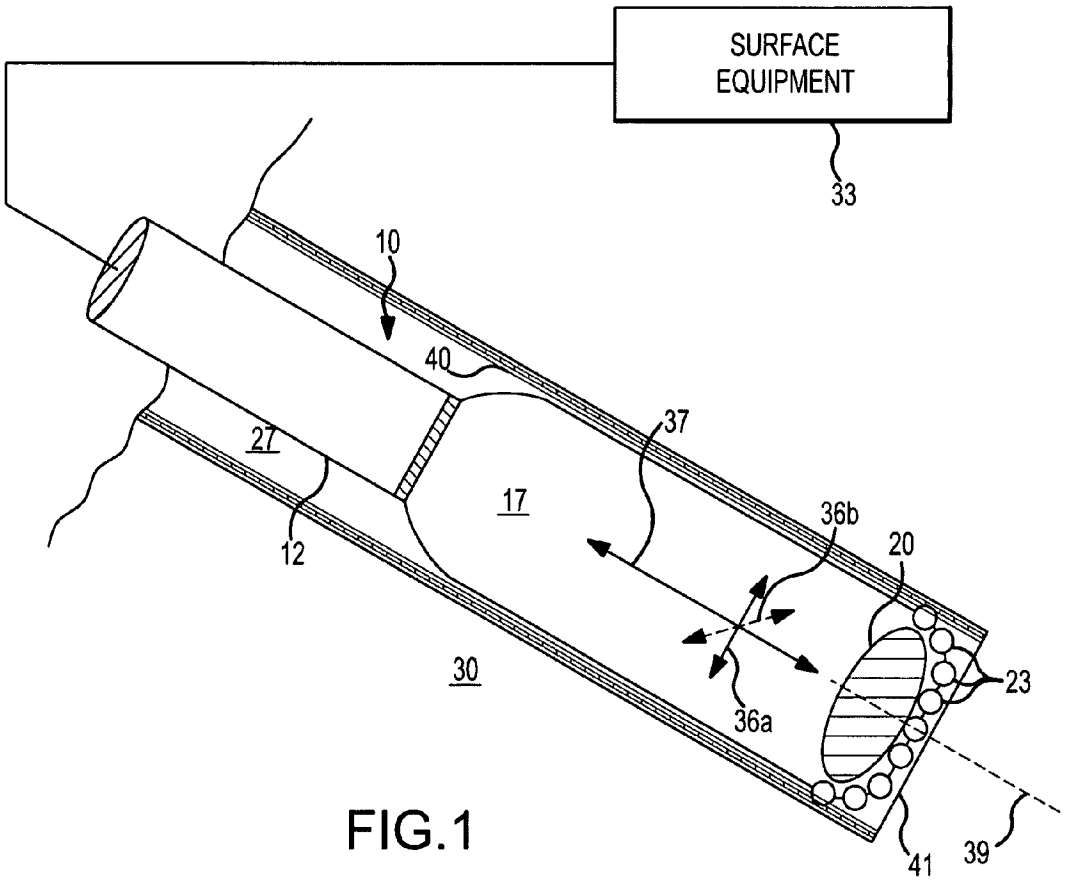
FIG. 1 is a schematic-type illustration of a system for drilling a borehole.

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. Various changes may be made in the function and arrangement of elements of the specification without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, structures, and other components may be shown as components in block diagram form in order not to obscure the embodiments in unnecessary detail. In other instances, well-known processes, techniques, and other methods may be shown without unnecessary detail in order to avoid obscuring the embodiments.

Also, it is noted that individual embodiments may be described as a process which is depicted as a flowchart, a flow diagram, a structure diagram, or a block diagram. Although a flowchart may describe the operations as a sequential process, many of the operations can be performed in parallel or concurrently. In addition, the order of the operations may be re-arranged. Furthermore, any one or more operations may not occur in some embodiments. A process is terminated when its operations are completed, but could have additional steps not included in a figure. A process may correspond to a method, a procedure, etc.

This disclosure relates in general to a method and a system for controlling a drilling system for drilling a borehole in an earth formation. More specifically, but not by way of limitation, embodiments of the present invention provide for using the heretofore unappreciated and uninvestigated noise of the drilling process—the unsteady/transient motion of the drilling system in the borehole during the drilling process and the interactions between the drilling system and the borehole resulting from the unsteady/transient motion of the drilling system—to control the drilling system and/or the drilling process.

Embodiments of the present invention encompass control systems and methods for temporarily, and synchronously with the rotation of a drill bit, preventing or inhibiting side cutters or a side-cutting action of a bit from cutting a wellbore. Such techniques are well suited for inhibiting or modulating cutting in a preferred stationary direction or trajectory. Often, steering a rotating bit is achieved either by applying a side force to the bit, in the direction one wishes to drill, or by pointing the bit in the required direction. These steering processes can be achieved by a number of mechanisms ranging from pushing pads out against the formation and thereby pushing the bit in the opposite direction, to orienting a manufactured bend in a borehole assembly above the bit. Other proposed methods include equipping a borehole assembly above the bit with a non-rotating eccentric stabilizer which similarly pushes/directs the bit in a chosen direction while drilling.

Advantageously, exemplary embodiments of the present invention can achieve effective steering of a drill bit with little or no additional power requirements. For example, while a drilling bit is drilling it is subject to random forces (e.g. forces derived ultimately from the instantaneous reactions at the various cutters) which cause the bit to 'clatter' in the hole, moving erratically in the borehole with no preferred direction, or which may cause the bit to preferentially move along a particular vector fixed in the frame of the rotating bit, as in the case of an anti-whirl bit. These random forces arise naturally as the bit rotates and there is no requirement to impose such forces on the bit. Hence, no directed forcing mechanism is required to generate such forces. Generally, in the case of random forces at the bit, or in the case of a rotating force vector, the bit does not exhibit a preferred directional tendency in the reference frame of the earth.

These randomly directed forces acting on the rotating bit can be harnessed, according to embodiments of the present invention, to steer or control the trajectory of the bit. Toward this end, embodiments of the present invention encompass means whereby the side cutters of the bit can be temporarily, and synchronously with the rotation, prevented or inhibited from cutting the wellbore. By applying an inhibition to cutting in a particular direction fixed in the frame of the earth, the bit, subject to the random forces described above, will tend, on average, to drill in the opposite direction. This directed inhibition to cutting can be achieved by any number of means which temporarily hold the side cutters away from the bore-wall, or which reduce the cutting action of the side cutters on a particular side of the bore-wall. An example comprises a pad or interaction element held on one side of the flank of the bit, fixed relative to the earth so as not to rotate with the bit, which may be thick enough to inhibit side cutting whenever the random forces acting on the bit caused the bit to move towards the pad or interaction element. Such a configuration can be extended in any number of ways. Typically, such a configuration inhibits or prevents the side cutting action of the bit in a particular direction.

With such a device, steering in a particular direction can be achieved by orienting the device so that the device inhibits cutting in a direction roughly fixed in the frame of the earth. So oriented, the bit can progressively drill in or toward the opposite direction. The fixed (geostatic) orientation of the cutting inhibition device can be achieved in any number of ways using, for example, a downhole geostationary mechanism, or a means of orienting the cutting inhibition device from surface. The device for inhibiting cutting on one side of the bit can be deployed at the bit, on the flanks of the bit for example, or just above the bit. In some instances, the inhibiting device or interaction element is disposed within about a meter of the bit. The interaction element may comprise pads, or a complete ring with a desired profile to inhibit cutting over a limited azimuthal range, or it may comprise a means of temporarily suppressing side cutting during the bit rotation.

In one embodiment of the present invention a system and method is provided for controlling interactions between the drilling system for drilling the borehole and an inner surface of the borehole being drilled, as a result of unsteady/transient motion of the drilling system during the drilling process, to provide for steering the drilling system to directionally drill a borehole through the earth formation. In certain aspects of the present invention, the drilling system may be controlled to provide that the borehole reaches a target objective or drills through a target objective. In another embodiment of the present invention, data regarding the functioning of the drilling system may be sensed and interactions between the drilling system for drilling the borehole and an inner surface of the borehole may be controlled in response to the sensed data to control the drilling system, i.e. the interaction between the drill bit and the earth formation etc., as the borehole is being drilled.

FIG. 1 is a schematic-type illustration of a system for drilling a borehole. As depicted, a drill-string 10 may comprise a connector system 12 and a bottomhole assembly 17 and may be disposed in a borehole 27. The bottomhole assembly 17 may comprise a drill bit 20 along with various other components (not shown), such as a bit sub, a mud motor, stabilizers, drill collars, heavy-weight drillpipe, jarring devices ("jars"), crossovers for various thread forms and/or the like. The bottomhole assembly 17 may provide force for the drill bit 20 to break the rock—which force may be provided by weight-on-bit or the like—and the bottomhole assembly 17 may be configured to survive a hostile mechanical environment of high temperatures, high pressures and/or corrosive chemicals. The bottomhole assembly 17 may include a mud motor, directional drilling and measuring equipment, measurements-while-drilling tools, logging-while-drilling tools and/or other specialized devices.

The drill collar may comprise component of a drill-string that may be used to provide weight-on-bit for drilling. As such, the drill collars may comprise a thick-walled heavy tubular component that may have a hollowed out center to provide for the passage of drilling fluids through the collar. The outside diameter of the collar may rounded to pass through the borehole 27 being drilled, and in some cases may be machined with helical grooves ("spiral collars"). The drill collar may comprise threaded connections, male on one end and female on the other, so that multiple collars may be screwed together along with other downhole tools to make the bottomhole assembly 17.

Gravity acts on the large mass of the drill collar(s) to provide a large downward force that may be needed by the drill bit 20 to efficiently break rock and drill through the earth formation. To accurately control the amount of force applied to the drill bit 20, a driller may carefully monitors the surface weight measured while the drill bit 20 is just off a bottom surface 41 of the borehole 27. Next, the drill-string (and the drill bit), may be slowly and carefully lowered until it touches the bottom surface 41. After that point, as the driller continues to lower the top of the drill-string, more and more weight is applied to the drill bit 20, and correspondingly less weight is measured as hanging at the surface. If the surface measurement shows 20,000 pounds [9080 kg] less weight than with the drill bit 20 off the bottom surface 41, then there should be 20,000 pounds force on the drill bit 20 (in a vertical hole). Downhole sensors may be used to measure weight-on-bit more accurately and transmit the data to the surface.

The drill bit 20 may comprise one or more cutters 23. In operation, the drill bit 20 may be used to crush and/or cut rock at the bottom surface 41 so as to drill the borehole 27 through an earth formation 30. The drill bit 20 may be disposed on the bottom of the connector system 12 and the drill bit 20 may be changed when the drill bit 20 becomes dull or becomes incapable of making progress through the earth formation 30. The drill bit 20 and the cutters 23 may be configured in different patterns to provide for different interactions with the earth formation and generation of different cutting patterns.

A conventional drill bit 20 operates by boring a hole slightly larger than the maximum outside diameter of the drill bit 20, the diameter/gauge of the borehole 27 resulting from the reach of the cutters of the drill bit 20 and the interaction of the cutters with the rock being drilled. This drilling of the borehole 27 by the drill bit 20 is achieved through a combination of the cutting action of the rotating drill bit 20 and the weight on the bit created as a result of the mass of the drill-string. Generally, the drilling system may include a gauge pad(s) which may extend outward to the gauge of the borehole 27. The gauge pads may comprise pads disposed on the bottomhole assembly 17 or pads on the ends of some of the cutters of the drill bit 20 and/or the like. The gauge pads may be used to stabilize the drill bit 20 in the borehole 27.

The connector system 12 may comprise pipe(s)—such as drillpipe, casing or the like—coiled tubing and/or the like. The pipe, coiled tubing or the like of the connector system 12 may be used to connect surface equipment 33 with the bottomhole assembly 17 and the drill bit 20. The pipe, coiled tubing or the like may serve to pump drilling fluid to the drill bit 20 and to raise, lower and/or rotate the bottomhole assembly 17 and/or the drill bit 20.

In some systems, the surface equipment 33 may comprise a topdrive, rotary table or the like (not shown) that may transfer rotational motion via the pipe, coiled tubing or the like to the drill bit 20. In some systems, the topdrive may consist of one or more motors—electric, hydraulic and/or the like—that may be connected by appropriate gearing to a short section of pipe called a quill. The quill may in turn be screwed into a saver sub or the drill-string itself. The topdrive may be suspended from a hook so that it is free to travel up and down a derrick. Pipe, coiled tubing or the like may be attached to the topdrive, rotary table or the like to transfer rotary motion down the borehole 27 to the drill bit 20.

In some drilling systems, drilling motors (not shown) may be disposed down the borehole 27. The drilling motors may comprise electric motors hydraulic-type motors and/or the like. The hydraulic-type motors may be driven by drilling fluids or other fluids pumped into the borehole 27 and/or circulated down the drill-string. The drilling motors may be used to power/rotate the drill bit 20 on the bottom surface 41. Use of drilling motors may provide for drilling the borehole 27 by rotating the drill bit 20 without rotating the connector system 12, which may be held stationary during the drilling process.

The rotary motion of the drill bit 20 in the borehole 27, whether produced by a rotating drill pipe or a drilling motor, may provide for the crushing and/or scraping of rock at the bottom surface 41 to drill a new section of the borehole 27 in the earth formation 30. Drilling fluids may be pumped down the borehole 27, through the connector system 12 or the like, to provide energy to the drill bit 20 to rotate the drill bit 20 or the like to provide for drilling the borehole 27, for removing cuttings from the bottom surface 41 and/or the like.

In some drilling systems, hammer bits may be used pound the rock vertically in much the same fashion as a construction site air hammer. In other drilling systems, downhole motors may be used to operate the drill bit 20 or an associated drill bit or to provide energy to the drill bit 20 in addition to the energy provided by the topdrive, rotating table, drilling fluid and/or the like. Further, fluid jets, electrical pulses and/or the like may also be used for drilling the borehole 27 or in combination with the drill bit 17 to drill the borehole 27.

In certain drilling processes, a bent pipe (not shown), known as a bent sub, or an inclination/hinge type mechanism may be disposed between the drill bit 20 and the drilling motor. The bent sub or the like may be positioned in the borehole to provide that the drill bit 20 meets the face of the bottom surface 41 in such a manner as to provide for drilling of the borehole 27 in a particular direction, angle, trajectory and/or the like. The position of the bent sub may be adjusted in the borehole without a need to remove the connector system 12 and/or the bottomhole assembly 17 from the borehole 27. However, directional drilling with a bent sub or the like may be complex because of forces in the borehole during the drilling process may make the bent sub difficult to manoeuvre and/or to effectively use to steer the drilling system.

During a drilling operation, forces which may act on the drill bit 20 may include gravity, torque developed by the drill bit 20, the end load applied to the drill bit 20, the bending moment from the drilling system including the connector system 12 and/or the like. These forces together with the type of formation being drilled and the inclination of the drill bit 20 to the face of the bottom surface 41 of the borehole 27 may create a complex interactive system of applied and reactionary forces. Various systems have sought to provide for directional drilling by controlling/applying these large forces to bend/shape/direct/push the drilling system and/or using these large forces and/or generating reaction forces from pushing outward into the earth formation 30 to orient the drilling system in the borehole and/or relative to the bottom of the borehole 27 and/or to push the drill bit 20 so as to steer the drilling system to directionally drill the borehole 27.

However, systems that use forces of the drilling process, for example, the end load, to steer the drilling system may be complicated and may not provide for accurate steering of the drilling system. Moreover, systems that steer the drilling system by moving/orienting the drilling system in the borehole and/or pushing the drill bit 20 may require generation downhole of large forces of over 1 kN and/or extension of elements from the drilling string a considerable distance beyond the cutting range of the drill bit—i.e. far beyond the silhouette of the drill bit, where the silhouette may be defined by the outer cutting edge of the drill bit 20—in order to generate the reaction forces used to move/orient the drilling system and/or to push the drill bit 20. To push or move the drilling system in the borehole when the drilling system is rotating may also require synchronization of application of thrusts by actuators against the wall of the borehole 27. Such power generation, large extension beyond the cutting silhouette of the drill bit 20 and/or thrust synchronization may require large and/or expensive motors and/or operation and control of complex synchronization systems and may complicate and/or increase the cost of the drilling machinery and the drilling process.

When drilling straight with a conventional drilling system, without application of lateral forces or the like, Applicants have determined that the drill bit 20 may, essentially, "vibrate" in the borehole 27, with the vibrations comprising repeated movement of the drill bit 20 in directions other than a drilling direction. The terms vibration/oscillation are used herein to describe repeated movements of the drilling system during the drilling process that may be in a direction in the borehole other than the drilling direction and may be random in nature.

These vibrations/oscillations of the drilling system may be limited by the effects of the cutters impacting and extending the surface of the hole and by the gauge pads or the like hitting the wall of the borehole 27. In tests, it was found that drilling systems comprising drill bits without gauge pads produce a borehole with a diameter that was significantly larger than equivalent drilling systems comprising drill bits and gauge pads. Analyzing results from these tests, it was determined that during operation of the drilling system, the bottomhole assembly 17 repeatedly undergoes a motion that involves movements away from a central axis of the bottomhole assembly 17 and/or the drill bit 20, i.e. in a radial direction towards an inner-wall 40 of the borehole 27, during the drilling process. Analysis of various drilling operations found that the gauge pads confine this radial motion of the bottomhole assembly 17 and/or the drill bit 20 so as to produce a borehole with a smaller bore. The gauge pads of conventional drilling systems being deployed to minimize/eliminate the vibrational motion of the drilling system to provide a smaller/regular bore.

From experimentation and analysis of drilling systems, Applicants found that when the drill bit 20 drills into the earth formation 30 the cutters 23 may not uniformly interact with the earth formation, for example chips may be generated from the earth formation 30, and, as a results, an unsteady motion, being a motion in a direction other then a longitudinal/forward motion of the bottomhole assembly 17 and/or the drill bit 20, may be generated in the bottomhole assembly 17 and/or the drill bit 20. Furthermore, Applicants have analyzed the operation of the drilling system and found that in addition to the unsteady/transient motion during operation of the drilling system, the application of force through the connector system 12 and the drill bit 20 on to the earth formation 30 at the bottom of the borehole 27, the operation/rotation of the drill bit 20, the interaction of the drill bit 20 with the earth formation 30 at the bottom of the borehole 27 (wherein the drill bit 20 may slip, stall, be knocked off of a drilling axis and/or the like), the rotational motion of the connector system 12, the operation of the topdrive, the operation of the rotational table, the operation of downhole motors, the operation of drilling aids such as fluid jets or electro-pulse systems, the bore of the borehole 20—which may be irregular—and/or the like may generate motion in the bottomhole assembly 17 and/or the drill bit 20, and this motion may be a repeated, random, transient motion, wherein at least a component of the motion is not directed along an axis of the bottomhole assembly 17 and/or the drill bit 20 and is instead directed radially outward from a longitudinal-type axis at a center of the bottomhole assembly 17 and/or the drill bit 20. As such, during a drilling operation, the kinetics of the bottomhole assembly 17 may comprise both a longitudinal motion 37 in the drilling direction as well as transient radial motions 36A and 36 B, wherein the transient radial motions 36A and 36 B may comprise any motion of the bottomhole assembly 17 directed away from a central axis 39 of the borehole 27 being drilled and/or a central axis of the bottomhole assembly 17 and/or the drill bit 20.

In general, it has been determined that the radial motion of the bottomhole assembly 17 during the drilling process may be random, transient in nature. As such, the bottomhole assembly 17 may undergo repeated random radial/unsteady motion throughout the drilling process. For purposes of this specification, the repeated radial/unsteady motion of the bottomhole assembly 17 in the borehole 27 during the drilling process may be referred to as a dynamic motion, a radial motion, an unsteady motion, a radial-dynamic motion, a radial-unsteady motion, a dynamic or unsteady motion of the bottomhole assembly 17 and/or the drill-string, a repeated radial motion, a repeated dynamic motion, a repeated unsteady motion, a vibration, a vibrational-type motion and/or the like.

The dynamic and/or unsteady motion of the bottomhole assembly 17 during the drilling of the borehole 27 may cause/result in the bottomhole assembly 17 repeatedly coming into contact with and/or impacting an inner surface of the borehole 27 throughout the drilling process. The inner surface of the borehole 27 comprising the inner-wall 40 and the bottom surface 41 of the borehole 27, i.e. the entire surface of the earth formation 30 that defines the borehole 27. As discussed previously, the dynamic and/or unsteady motion of the bottomhole assembly 17 may be random in nature and, as such, may cause/result in random intermittent/repeat contact and/or impact between the bottomhole assembly 17 and the inner surface during the drilling process.

The intermittent/repeated contact and/or impact between the drill-string 10 and the inner surface during the drilling process resulting from dynamic and/or unsteady motion of the bottomhole assembly 17 may occur between one or more sections/components of the drill-string 10 and the inner surface. For example, the sections/components may be a section of the drill-string 10 proximal to the drill bit 20, the bottomhole assembly 17, a component of the bottomhole assemble 17, such as for example a drill collar, gauge pads, stabilizers, a motor housing, a section of the connector system 12 and/or the like. For purposes of this specification, the interactions between the drill-string 10 and the inner surface caused by/resulting from the dynamic and/or unsteady of the bottomhole assembly 17 may be referred to as dynamic interactions, unsteady interactions, radial motion interactions, vibrational interactions and/or the like.

Figure 2B:
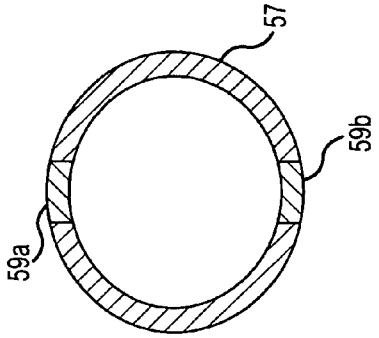
FIG. 2B is a cross-sectional view through a compliant system for use in the system for steering the drilling system for drilling the borehole of FIG. 2A, in accordance with an embodiment of the present invention.
Figure 2A:
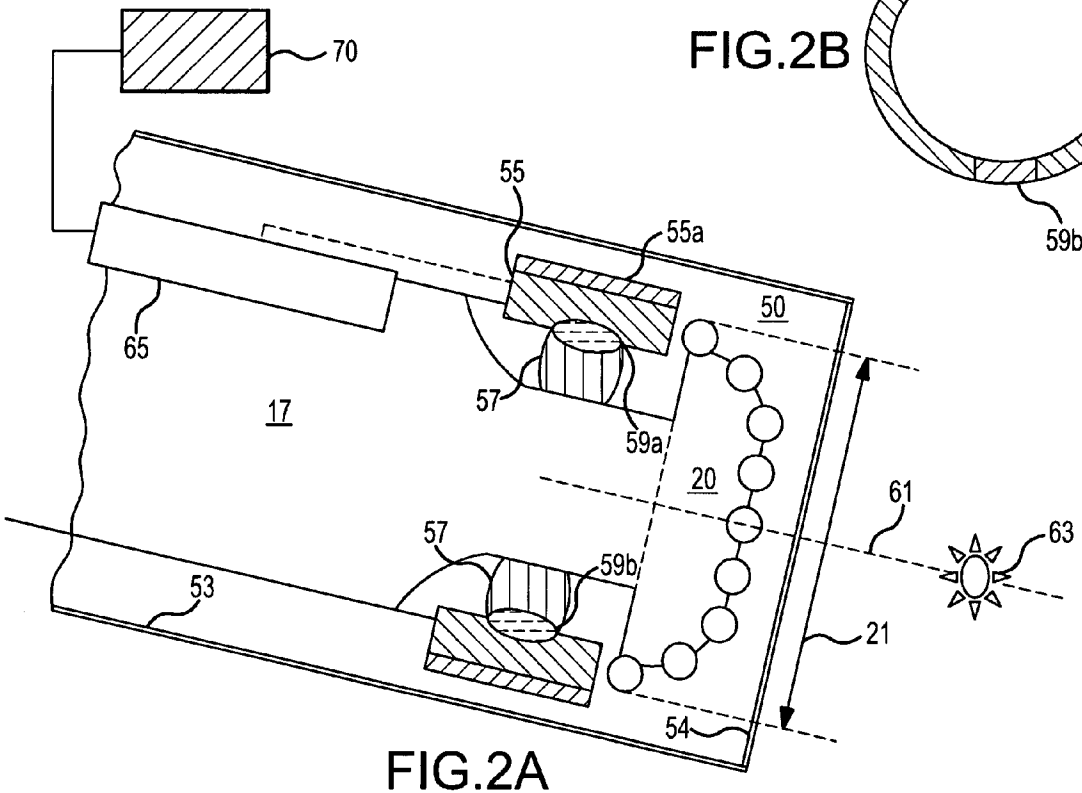
FIG. 2A is a schematic-type illustration of a system for steering a drilling system for drilling a borehole, in accordance with an embodiment of the present invention.

FIG. 2A is a schematic-type illustration of a system for steering a drilling system for drilling a borehole, in accordance with an embodiment of the present invention. In FIG. 2A, the drilling system for drilling the borehole may comprise the bottomhole assembly 17, which may in-turn comprise the drill bit 20. The drilling system may provide for drilling a borehole 50 having an inner-wall 53 and a drilling-face 54.

During the drilling process, the drill bit 20 may contact the drilling-face 54 and crush/displace rock at the drilling-face 54. In an embodiment of the present invention, a collar assembly 55 may be coupled with the bottomhole assembly 17 by a compliant element 57. The collar assembly 55 may be a tube, cylinder, framework or the like. The collar assembly 55 may have an outer-surface 55A.

In certain aspects where the collar assembly 55 comprises a tube, cylinder and/or the like the outer-surface 55A may comprise the outer-surface of the tube/cylinder and/or any pads, projections and/or the like coupled with the outer surface of the tube/cylinder. The collar assembly 55 may have roughened sections, coatings, projections on its outer surface to provide for increased frictional contact between an outer-surface of the collar assembly 55 and the inner-wall 53. The collar assembly 55 may comprise pads configured for contacting the inner-wall 53.

In certain aspects, the collar assembly 55 may comprise a gauge pad system. In aspects where the collar assembly 55 may comprise a series of elements, such as pads or the like, the outer-surface 55A may be defined by the outer-surfaces of each of the elements (pads) of the collar assembly 55. In an embodiment of the invention, the collar assembly 55 may be configured with the bottomhole assembly 17 to provide that the outer-surface 55A engages, contacts, interacts and/or the like with the inner-wall 53 and/or the drilling-face 54 during the drilling process as a result of the dynamic motion of the bottomhole assembly 17. The design/profile/compliance of the outer-surface 55A and/or the disposition of the outer-surface 55A relative to a cutting silhouette of the drill bit 20 may provide for controlling the dynamic interaction between the outer-surface 55A and the inner-wall 53 and/or the drilling-face 54.

The compliant element 57 may comprise a structure that provides a lateral movement of the collar assembly 55 relative to the drill bit 20, where the lateral movement is a movement that is, at least in part directed, towards a center axis 61 of the bottomhole assembly 17. In certain aspects, the collar assembly 55 may itself be configured to be laterally compliant and may be coupled to the bottomhole assembly 17 and/or may be a section of the bottomhole assembly 17, without the use of the compliant element 57.

In one embodiment of the present invention, the compliant element 57 may not be uniformly-circumferentially compliant. In such an embodiment, one or more sections of the compliant element 57 disposed around the circumference of the compliant element 57 may be more laterally compliant than other sections of the compliant element 57.

As observed previously, during the drilling process the bottomhole assembly 17 or one or more sections of the bottomhole assembly 17 may undergo dynamic interactions with the inner-wall 53 and/or the drilling-face 54. In an embodiment of the present invention, the collar assembly 55 may be configured to provide that dynamic motion of the bottomhole assembly 17 produces dynamic interactions between the collar assembly 55 and the inner-wall 53 and/or the drilling-face 54 during the drilling process. In different aspects of the present invention, different relative outer-circumferences as between the collar assembly 55 and the bottomhole assembly 17 and/or the drill bit 20 may provide for different dynamic interactions between the collar assembly 55 and the inner-wall 53 and/or the drilling-face 54. Modeling, theoretical analysis, experimentation and/or the like may be used to select differences in the relative outer-circumference between the collar assembly 55 and the bottomhole assembly 17 and/or the drill bit 20 for a particular drilling process to produce the wanted/desired dynamic interaction.

In an embodiment of the present invention in which the lateral compliance varies circumferentially around the compliant element 57, the dynamic interaction between the collar assembly 55 and the inner-wall 53 and/or the drilling-face 54 may not be uniform circumferentially around the collar assembly 55. Merely by way of example, the compliant element 57 may comprise an area of decreased compliance 59B and an area of increased compliance 59A. In certain aspects, dynamic interactions between the collar assembly 55 and the inner-wall 53 and/or the drilling-face 54 above a section of the compliant element 57 having increased lateral compliance, i.e., the area of increased compliance 59A, may be damped in comparison with dynamic interactions between the collar assembly 55 and the inner-wall 53 and/or the drilling-face 54 above a section of the compliant element 57 having decreased lateral compliance, i.e., the area of decreased compliance 59B.

In some embodiments of the present invention, the collar assembly 55 may be configured to provide that the collar assembly 55 is coupled with the bottomhole to provide that collar assembly 55 is disposed entirely within a cutting silhouette 21 of the drill bit 20, the cutting silhouette 21 comprising the edge-to-edge cutting profile of the drill bit 20. In other embodiments of the present invention, the collar assembly 55, a section of the collar assembly 55, the outer-surface 55A and/or a section of the outer-surface 55A may extend beyond the cutting silhouette 21. Merely by way of example, the collar assembly 55 may be coupled with the bottomhole assembly 17 to provide that the outer outer-surface 55A is of the order of 1-10s of millimeters inside the cutting silhouette 21. In other aspects, and again merely by way of example, the collar assembly 55 may be coupled with the bottomhole assembly 17 to provide that at least a portion of the outer-surface 55A extends in the range up to 10s of or more millimeters beyond the cutting silhouette 21.

FIG. 2B is a cross-sectional view through a compliant system for use in the system for steering the drilling system for drilling the borehole of FIG. 2A, in accordance with an embodiment of the present invention. The compliant element 57 viewed in cross-section in FIG. 2B comprises the area of increased compliance 59A and the area of decreased compliance 59B. In certain aspects, there may only be a single area in the compliant element 57 that has an increased or a decreased compliance relative to the rest of and/or the other areas of the compliant element 57. In other aspects, the compliant element 57 may comprise any configuration of compliance that produces non-uniform compliance around the compliant element 57

In FIG. 2B, the compliant element 57 is depicted as a solid cylindrical structure, however, in different aspects of the present invention, the compliant element 57 may comprise other kinds of structures, such as a plurality of compliant elements arranged around the bottomhole assembly 17 and configured to couple the collar assembly 55 to the bottomhole assembly 17, an assembly of support elements capable of coupling the collar assembly 55 to the bottomhole assembly 17 and providing lateral movement of the collar assembly 55 and/or the like. In other aspects of the present invention, the collar assembly 55 may itself be a structure with integral compliance, wherein the integral compliance may be selected to be non-uniform around the collar assembly 55 and the collar assembly 55 may be coupled with the bottomhole assembly 17 or maybe a section of the bottomhole assembly 17 without the compliant element 57. In still further aspects, the collar assembly 55 may comprise a plurality of compliant elements, such as pads or the like, the plurality of compliant elements being coupled with the bottomhole assembly 17 and at least one of the compliant elements having a compliance that is different from the other compliant elements.

In an embodiment of the present invention, the area of increased compliance 59A may be disposed on the compliant element 57 so as to be diametrically opposite the area of decreased compliance 59B. In such an embodiment, the compliant element 57 may prevent the collar assembly 55 from moving inwards at the location of the area of decreased compliance 59B (upwards as depicted in FIG. 2A), but may allow the collar assembly 55 to move inwards at the area of increased compliance 59A (downward as depicted in FIG. 2A). As a result, the drill bit 20, as it undergoes dynamic motion during the drilling process, may interact with the inner-wall 53 and/or the drilling-face 54 and may tend to move, be oriented or preferentially crush/remove rock in the direction of and/or towards the area of increased compliance 59A (upward as depicted in FIG. 2A). In such an embodiment, as a result of the compliant element 57 having a selected non-uniform compliance, during the drilling process, as a result of the dynamic motion of the bottomhole assembly 17 and the drill bit 20, the compliant element 57 may provide for the drilling system to be steered and may provide for directional drilling of the borehole 50. The non-uniform interaction of the drilling system and the inner surface of the borehole 27 may also be used to control the interactions of, and as a result the functioning of, the drill bit 20 with the earth formation, during the drilling process.

In embodiments of the present invention, any non-uniform circumferential compliance of the collar assembly 55 or the compliant element 57 may provide for steering/controlling the drilling system. The amount of differential compliance in the collar assembly 55 and/or the compliant element 57 and/or the profile of the non-uniform compliance of the collar assembly 55 and/or the compliant element 57 may be selected to provide the desired steering response and/or control of the drill bit 20. Steering response and/or drill bit response of a drilling system for a compliance differential and/or a circumferential compliance profile may be determined theoretically, modeled, deduced from experimentation, analyzed from previous drilling processes and/or the like.

In embodiments of the present invention configured for use with a drilling system that does not involve the use of a rotating drill bit or where a housing of the drilling system, e.g., a housing of the bottomhole assembly is non-rotational, the collar assembly 55 and/or the compliant element 57 may be coupled with the drilling system or the housing. In such an embodiment, the drilling system may be disposed in the borehole with the area of increased compliance 59A disposed at a specific orientation to the drill bit 20 to provide for drilling of the borehole 50 in the direction of the area of increased compliance 59A. To change the direction of drilling by the drilling system, the position of the area of increased compliance 59A may be changed.

In some embodiments, a positioning device 65—which may comprise a motor, a hydraulic actuator and/or the like—may be used to rotate/align the collar assembly 55 and/or the compliant element 57 to provide for drilling of the borehole 50 by the drilling system in a desired direction. The positioning device 65 may be in communication with a processor 70. The processor 70 may control the positioning device 65 to provide for desired directional drilling.

The processor 70 may determine a position of the collar assembly 55 and/or the compliant element 57 in the borehole 50 from manual intervention, an end point objective for the borehole, a desired drilling trajectory, a desired drill bit response, a desired drill bit interaction with the earth formation, seismic data, input from sensors (not shown)—which may provide data regarding the earth formation, conditions in the borehole 50, drilling data (such as weight on bit, drilling speed and/or the like) vibrational data of the drilling system, dynamic interaction data and/or the like—data regarding the location/orientation of the drill bit in the earth formation, data regarding the trajectory/direction of the borehole and/or the like.

The processor 70 may be coupled with a display (not shown) to display the orientation/direction/location of the borehole 50, the drilling system, the drill bit 20, the collar assembly 55, the compliant element 57, the drilling speed, the drilling trajectory and/or the like. The display may be remote from the drilling location and supplied with data via a connection such as an Internet connection, web connection, telecommunication connection and/or the like, and may provide for remote operation of the drilling process. Data from the processor 70 may be stored in a memory and/or communicated to other processors and/or systems associated with the drilling process.

In another embodiment of the present invention, the steering/drill bit functionality control system may be configured for use with a rotary-type drilling system in which the drill bit 20 may be rotated during the drilling process and, as such, the drill bit 20 and/or the bottomhole assembly 17 may rotate in the borehole 50. In such an embodiment, the collar assembly 55 and/or the compliant element 57 may be configured so that motion of the collar assembly 55 and/or the compliant element 57 is independent or at least partially independent of the rotational motion of the drill bit 20 and/or the bottomhole assembly 17. As such, the collar assembly 55 may be held geostationary in the borehole 50 during the drilling process.

In certain aspects, the collar assembly 55 and/or the compliant element 57 may be a passive system comprising one or more cylinders disposed around the drilling system. The one or more cylinders may in some instances be disposed around the bottomhole assembly 17 of the drilling system. The one or more cylinders may be configured to rotate independently of the drilling system. In such aspects, the one or more cylinders may be configured to provide that friction between the one or more cylinders and the formation may fix, prevent rotational motion of, the one or more cylinders relative to the rotating drilling system. In certain aspects of the present invention, the one or more cylinders may be locked to the bottomhole assembly when there is no weight-on-bit, and hence no drilling of the borehole, and then oriented and unlocked from the bottomhole assembly when weight-on-bit is applied and drilling commences; the friction between the one or more cylinders and the inner surface maintaining the orientation of the one or more cylinders. In some aspects of the present invention, the one or more cylinders may be coupled with the bottomhole assembly 17 by a bearing or the like.

In some embodiments of the present invention, the positioning of the one or more cylinders may be provided, as in a non-rotational drilling system, by the positioning device 65, which may rotate the one or more cylinders to change the location of an active area of the cylinder in the borehole 50 to change the drilling direction and/or the functioning of the drill bit 20. For example, the compliant element 57 may comprise a cylinder and maybe rotated around the bottomhole assembly 17 to change a location of the area of increased compliance 59A and/or the area of decreased compliance 59B to change the drilling direction of the drilling system resulting from the dynamic interaction between the collar assembly 55 and the inner-wall 53. Alternatively, an active control may be used to maintain a desired orientation/position of the collar assembly 55 and/or the compliant element 57 with respect to the bottomhole assembly 17 during the drilling process. In addition this type of device could be used in a motor assembly to replace the bent sub. This could bring benefits in terms of tripping the assembly into the hole through tubing and completion restrictions and when drilling straight in rotary mode.

Figure 3B:
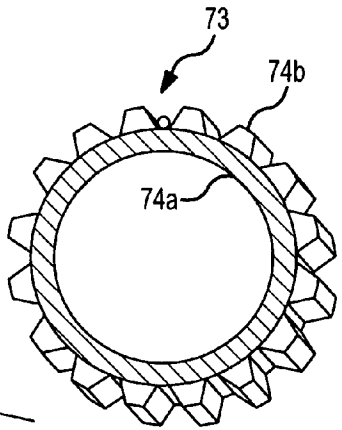
FIGS. 3A-C are schematic-type illustrations of a cam control system for steering a drilling system, in accordance with an embodiment of the present invention.
Figure 3C:
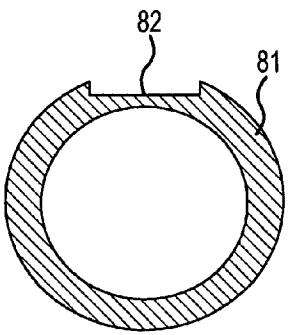
Figure 3A:
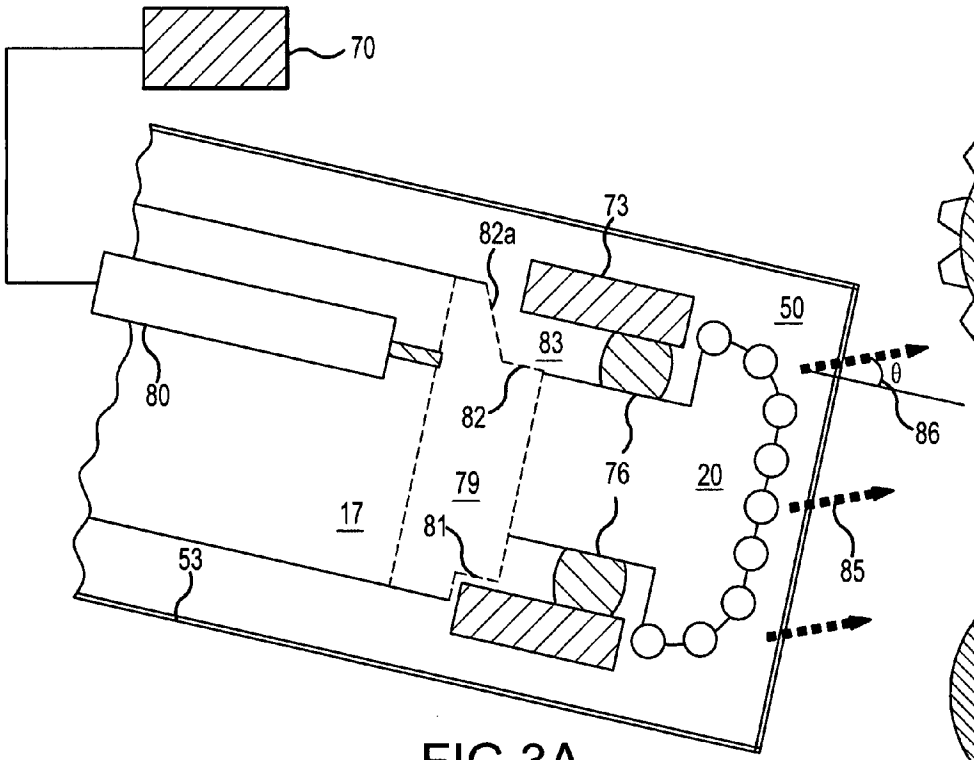

FIGS. 3A-C are schematic-type illustrations of a cam control system for steering a drilling system, in accordance with an embodiment of the present invention. FIG. 3A illustrates the directional drilling system with the cam control system, in accordance with an embodiment of the present invention. In FIG. 3A, a drilling system is drilling the borehole 50 through an earth formation. The drilling system comprises the bottomhole assembly 17 disposed at an end of the borehole 50 to be/being drilled. The bottomhole assembly 17 comprises the drill bit 20 that contacts the earth formation and drills the borehole 50.

In an embodiment of the present invention, a gauge pad assembly 73 may be coupled with the bottomhole assembly 17 by a compliant coupler 76. The gauge pad assembly 73 may comprise a drill collar, a cylinder, non-cutting ends of one or more cutters of the drill but 20 and/or the like. FIG. 3B illustrates the gauge pad assembly 73 in accordance with one aspect of the present invention. As depicted, the gauge pad assembly 73 comprises a cylinder 74A with a plurality of pads 74B disposed on the surface of the cylinder 74A. In some aspects, the plurality of pads 74B may have compliant properties while in other aspects the plurality of pads 74B may be non-compliant and may comprise a metal. In some embodiments of the present invention, the gauge pad assembly 73 may itself be compliant and the compliant gauge pad assembly may be coupled with/an element of the bottomhole assembly 17 without the compliant coupler 76.

In one embodiment of the present invention, a cam 79 may be coupled with the bottomhole assembly 17. The cam 79 may be moveable on the bottomhole assembly 17. In an embodiment of the present invention, the cam 79 may comprise an eccentric/non/symmetrical cylinder. The cam 79 may be moveable so as to contact the gauge pad assembly 73. The gauge pad assembly 73 may be configured to contact the inner-wall 53 and/or the drilling-face 54 during the process of drilling the borehole 50. The gauge pad assembly 73 may be directly coupled with the bottomhole assembly 17, coupled to the bottomhole assembly 17 by a coupler 76 or the like. The coupler 76 may comprise a compliant/elastic type of material that may allow for movement of the gauge pad assembly 73 relative to the bottomhole assembly 17.

The cam 79 may be actuated by a controller 80. The controller 80 may comprise a motor, hydraulic system and/or the like and may provide for moving the cam 79 and/or maintaining the cam 79 to be geostationary in the borehole 50 during the drilling process. In some aspects, the cam 79 may comprise a cylinder with an outer surface 81 and an indent 82 in the outer surface 81. In such aspects, during the drilling process, the controller 80 may provide for moving the cam 79 to an active position wherein the outer surface 81 may be proximal to or in contact with the gauge pad assembly 73. In some embodiments of the present invention, there may not be a controller 80 and the cam 79 may, for example, be set to the active position prior to locating the bottomhole assembly 17 in the borehole 50.

In one embodiment of the present invention, the cam 79 may be used to control the dynamic interactions between the gauge pad assembly 73 and the inner-wall 53 and/or the drilling-face 54 by providing that the properties of the gauge pad assembly 73 are non-uniform around the gauge pad assembly 73. In further embodiments of the present invention, instead of using the cam 79 to change the properties, positioning and/or the like of the gauge pad assembly 73, piezoelectric, hydraulic and/or other mechanical actuators may be used to provide that the gauge pad assembly 73 has non-uniform properties that may and the non-uniform properties may be used to control the dynamic interactions between the gauge pad assembly 73 and the inner-wall 53 and/or the drilling-face 54.

In the active position, i.e., where the cam 79 is engaged with the gauge pad assembly 73, movement of the gauge pad assembly 73 in a lateral direction, i.e. towards a central axis of the bottomhole assembly 17 and/or the borehole 50 may be resisted by the cam 79. In the active position, the indent 82 may be separated from the gauge pad assembly 73 by a spacing 83, where the spacing 83 is greater than the spacing between the gauge pad assembly 73 and the outer surface 81 at the other positions around the system. As such, a part of the gauge pad assembly 73 above the indent 82 may have more freedom/ability to move laterally in comparison to the other sections of the gauge pad assembly 73 disposed above the outer surface 81. Consequently, interactions between the gauge pad assembly 73 and the inner-wall 53 and/or the drilling-face 54 during the drilling process will not be uniform around the gauge pad assembly 73.

In certain aspects of the present invention, the cam 79 may be used to control an offset of the gauge pad assembly 73, either to produce the offset of the gauge pad assembly 73 to steer the drilling system or to mitigate the offset in the gauge pad assembly 73 to provide for straight drilling. In embodiment for controlling operation of the drill bit 20 the cam 79 may be used to control an offset of the gauge pad assembly 73, either to produce the offset of the gauge pad assembly 73 to produce a certain behaviour of the drill bit 20 or to mitigate the offset in the gauge pad assembly 73 to different behaviour of the drill bit 20.

The cam 79 may comprise an eccentric cylinder. In operation, the cam 79 may be engaged with the gauge pad assembly 73 and may provide that at least a section of the gauge pad assembly 73 may be over gauge with respect to the drill bit 20.

As a result, the gauge pad assembly 73 being over-gauged may interact with the inner-surface of the borehole 50 in a non-uniform manner. The cam 79 may have a section with a steadily varying outer-diameter to provide for steadily varying the gauge/diameter of at least a section of the gauge pad assembly 73 during a drilling process.

During the drilling process, the bottomhole assembly 17 may undergo dynamic motion in the borehole 50 resulting in dynamic interactions between the bottomhole assembly 17 and the inner-surface of the borehole 50. In an embodiment of the present invention, because of the greater compliance of the gauge pad assembly 73 above the indent 82 compared to the compliance of the gauge pad assembly 73 at a position on the opposite side of the gauge pad assembly 73 relative to the indent, repeated dynamic interactions between the gauge pad assembly 73 and the inner-wall 53 and/or the drilling-face 54 will cause the drilling system to drill in a drilling direction 85, where the drilling direction 85 is directed in the direction of the of the indent 82. When engaged, the cam 79 may prevent the gauge pad assembly 73 moving inwards (upwards as drawn), but may allow the gauge pad assembly 73 to move in opposite direction (downwards as drawn). As a result, the drill bit 20 will move, vibrate, upward relative to the gauge pad assembly 73 and hence provide for drilling by the drilling system in an upward direction, towards the indent 82, to produce an upward directed section of the borehole 50.

In an embodiment of the present invention, the cam 79 may provide for offsetting the axis of the gauge pad assembly 73 from the axis of the drill bit 20 in a geostationary plane. In certain aspects, the offsetting of the gauge pad assembly 73 by the cam 79 may be provided while the gauge pad assembly 73 is rotating with the drill bit 20 and/or the bottomhole assembly 17.

When using a drilling system to drill a curved section of a borehole, for example a curved section with a 10 degree/100 ft deflection, the actual side tracking of the borehole may be small; for example, in such a curved section, for a forward drilling of the borehole of 150 mm (6 in) the side tracking of the borehole is 0.07 mm. In embodiments of the present invention, because the side tracking to produce curved sections with deflections of the order of 10 degree per 100 feet is small, the system for producing controlled, non-uniform dynamic interactions with the inner surface of the borehole during the drilling process may only need to generate a small deflection of the borehole. In experiments with embodiments of the present invention, control of the dynamic interactions using collar/gauge-pad assemblies with an eccentric circumferential profile relative to a center axis of the bottomhole assembly and/or the drill bit, including eccentric profiles that were over-gauge and/or under-gauge relative to the drill bit, produced steering of curved sections of the borehole with such desired curvatures.

In certain aspects of the present invention, to minimize power requirements, the gauge pad assembly 73 may be mounted on the compliant coupler 76 with the axis of the gauge pad assembly 73 coinciding with the axis of the drill bit 20 and/or the cutting system that may comprise the drill bit 20. In an embodiment of the present invention, steering of the drilling system may be achieved by using the cam 79 to constrain the direction of the compliance of the compliant coupler 76 so the gauge pad assembly 73 may move in one direction, but is very stiff (there is a resistance to radial movement) in the opposite direction. In certain aspects, to steer the drilling system to drill straight, that cam 79 may be engaged so as to make the movement of the gauge pad assembly 73 system stiff (resistant to radial motion) in all directions.

In an embodiment of the present invention, the gauge pad assembly 73 may comprise a single ring assembly carrying the gauge pads in gauge with the drill bit 20. In certain aspects, a small over or under gauge may be tolerable. In alternative embodiments, the pads on the gauge pad assembly 73 may be mounted on the ring assembly independently and/or may be independently controlled. The gauge pad assembly 73 may be mounted on a stiff compliant structure and may move radially relative to the drill bit 20. The cam 79 may be eccentric and may be configured to be geostationary when steering the drilling system and drawn in, removed and/or the like when the drill-string is being tripped or steering is not desired. By maintaining the cam 79 in a geostationary position, the active part of the cam 79, such as the indent 83 or the like, may be maintained in a geostationary position relative to the borehole 50 to provide for drilling of the borehole 50 in a desired direction, for example in the direction of the geostationary indent 83. In certain aspects, the cam 79 may be geostationary and the gauge pads or the like may be free to rotate during the drilling process.

As provided previously, various methods may be used to couple the gauge pad assembly 73 with the drill bit 20 and/or the bottomhole assembly 17. In certain aspects, the mounting may be radially compliant, but may also be capable of transmitting torque and axial weight to the bottomhole assembly 17. In one embodiment of the present invention, the compliant coupler 76, which may be a mounting or the like, may comprise a thin walled cylinder with slots cut in the cylinder so as to allow radial flexibility but maintain tangential and axial stiffness. Other embodiments may include bearing surfaces to transmit the weight and/or pins and/or pivoting arms which may be used to transmit the torque.

Using a configuration of the gauge pad assembly 73 and/or the compliant coupling 76 that may keep the indent 82 (or an over-gauge, under-gauge section of the cam 79 or a combination of the cam 79 and the gauge pad assembly 73 or a radially stiff or radially compliant section of the gauge pad assembly 73) geostationary in the borehole 50, the drilling system may be controlled to directionally drill the borehole 50. In some embodiments of the present invention, the processor 75 may be used to manage the controller 80 to provide for rotation of the cam 79 during or between drilling operations to continuously control the direction of the drilling process. In some embodiments, the indent 82 may have a graded profile 82A to provide for a varying depth of the indent 82. In such embodiments, the relative compliance of the gauge pad assembly 73 between a section of the gauge pad assembly 73 above the indent 82 relative to a section of the gauge pad assembly 73 not above the indent 82 may be varied. In this way, in certain embodiments of the present invention an acuteness (θ) 86 of the drilling direction 85 may be variably controlled.

In some aspects of the present invention, a plurality of indents may be provided in the cam 79 to provide for control of the interactions between the gauge pad assembly 73 and the inner-wall 53. The plurality of indents may be disposed at different positions around the circumference of the cam 79 to provide the desired steering effect. Furthermore, a plurality of cams may be used in conjunction with one or more gauge pad assemblies on the bottomhole assembly 17 to provide different steering effects during the drilling process.

Figure 4A:
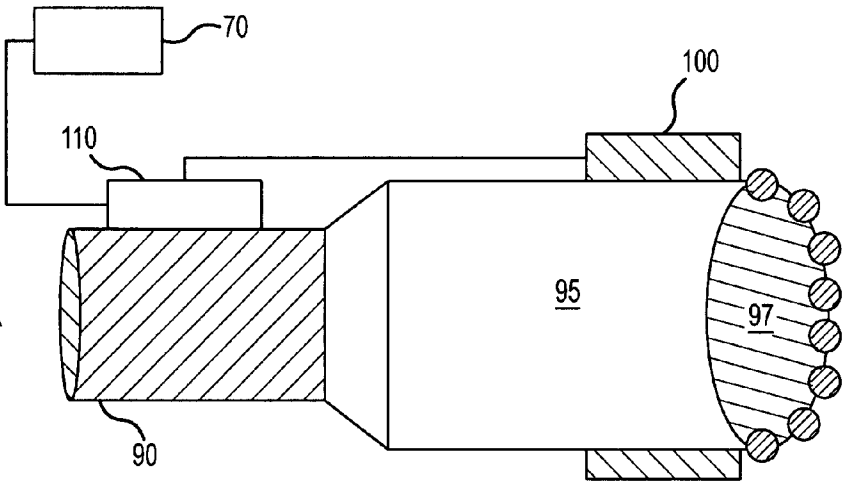
FIGS. 4A-C are schematic-type illustration of active gauge pad systems for steering a drilling system configured for drilling a borehole, in accordance with an embodiment of the present invention.
Figure 4B:
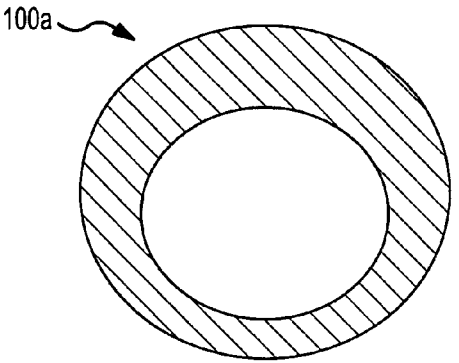
Figure 4C:
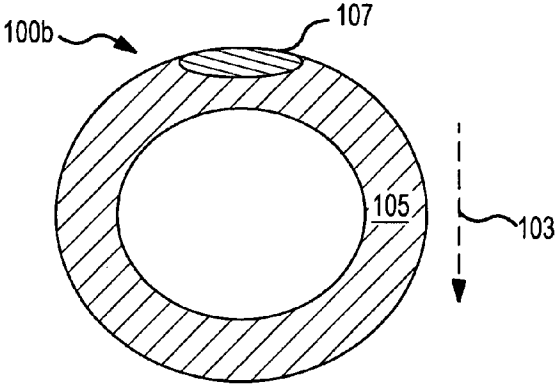

FIGS. 4A-C are schematic-type illustration of active gauge pad systems for controlling a drilling system configured for drilling a borehole, in accordance with an embodiment of the present invention. In an embodiment of the present invention, an active gauge pad 100 may be used to control a drilling system for drilling a borehole that may comprise a drill pipe 90 coupled with a bottomhole assembly 95. The bottomhole assembly 95 may comprise a drill bit 97 for drilling the borehole. The active gauge pad 100 may comprise a drill collar, a gauge pad, a section of the bottomhole assembly, a tubular assembly, a section of the drill bit and/or the like that may interact with the inner surface of the borehole being drilled in a non-uniform manner.

The active gauge pad 100 may comprise a disc, a cylinder, a plurality of individual elements—for example a series of pads disposed around the circumference of the bottomhole assembly 95 or the drill pipe 90—that may be coupled with the drilling system and may interact with the inner surface of the borehole being drilled during the drilling process. In certain aspects, to provide for repeated interaction between the active gauge pad 100 or the like and the inner surface of the borehole, the active gauge pad 100 may be coupled with the drilling system so as to be less than 20 feet from the drill bit 97. In other aspects, the active gauge pad 100 may be coupled with the drilling system so as to be less than 10 feet from the drill bit 97.

In embodiments of the present invention, the active gauge pad 100 may be moveable in the borehole. As such, the active gauge pad 100 may be aligned in the borehole using an actuator or the like to an orientation in the borehole to produce the desired control of the drilling system as a result of the non-uniform interactions of the active gauge pad 100, as oriented in the borehole, with the inner surface of the borehole. Using a processor or the like to control positioning of the active gauge pad 100 in the borehole, the operation and/or steering of the drilling system may be controlled/managed, and this control/management may, in some aspects, occur in real-time.

In FIG. 4A the active gauge pad 100 is coupled with the bottomhole assembly 95 to provide for interaction with the inner surface of the borehole being drilled at a location proximal to the drill bit 97. In a drilling system in which the drill pipe 90, the bottom hole assembly 95 and/or the like are rotated during drilling operations the active gauge pad 100 may be configured to be held geostationary during drilling operations. An actuator, frictional forces and/or the like may be used to hold the active gauge pad 100 geostationary. Merely by way of example, in one embodiment of the present invention, the active gauge pad may be coupled with the bottomhole assembly 95 at a distance of less than 10-20 feet behind the drill bit 97.

FIG. 4B illustrates one embodiment of the active gauge pad of the system depicted in FIG. 4A. In FIG. 4B, in accordance with an embodiment of the present invention, an active gauge pad 100A may comprise an element that is asymmetric. By coupling the asymmetric active gauge pad with the drill-string so that an outer-surface of the gauge pad 100A extends beyond an outer-surface of the drill string, the outer surface of the asymmetric active gauge pad may interact with the inner surface of the borehole being drilled. Since the active gauge pad 100A has a non-symmetrical outer surface, the active gauge pad 100A may interact with the inner surface of the borehole as a result of dynamic motion of the drill-string during the drilling process in a non-uniform way that will depend upon the non-symmetrical configuration of the active drill pad 100A.

Merely by way of example, the active gauge pad 100A may be asymmetric in design and may be configured to be coupled with the bottomhole assembly as provided in FIG. 4A at a distance in a range of several inches to 10-20 feet behind the drill bit. In some embodiments, the active gauge pad 100A may comprise a uniform cylinder and may be arranged eccentrically on the bottomhole assembly to provide for a non-uniform interaction with the inner surface as a result of the dynamic motion of the drill string.

In certain embodiments, the active gauge pad 100A may comprise a geostationary tube and may be slightly under gauge on one side. In other embodiments, the active gauge pad 100A may be under gauge on one side and over gauge on the opposite side. In some aspects, the active gauge pad 100A may comprise a plurality of geostationary tubes that are under/over gauged circumferentially and that may be coupled around the circumference of the drill pipe 90 and/or the bottomhole assembly 95. In some embodiments of the present invention, the active gauge pad 100A may be configured to provide that the active gauge pad 100A is coupled with the drill string so that the active gauge pad 100A is disposed entirely with a cutting silhouette of the drill bit; the cutting silhouette comprising the edge-to-edge cutting profile of the drill bit. In other embodiments of the present invention, a section or all-of-the active gauge pad 100A may extend beyond the cutting silhouette of the drill bit.

Merely by way of example, the active gauge 100A may be coupled with the drill-string to provide that the outer surface of the active gauge 100A is of the order of 1-10s of millimeters inside the cutting silhouette. In other aspects, and again merely by way of example, the active gauge 100A may be coupled with the drill-string to provide that at least a portion of the outer surface of the active gauge pad 100A extends in the range of tenths to 10s of more millimeters beyond the cutting silhouettes.

In an embodiment of the present invention, the active gauge pad 100A—because the active gauge pad 100A is non-concentric with the bottomhole assembly, asymmetric and/or the like—may interact with the inner surface of the borehole being drilled as a result of radial motion of the drilling system in the borehole during the drilling process in a non-uniform manner. Repeated dynamic interactions between the active gauge pad 100A, as depicted in FIG. 4B, and the inner surface of the borehole during a drilling process may result in the drilling system tending to drill in a downward direction 103, as provided in the figure. By maintaining the active gauge pad 100A geostationary during the drilling process, the active gauge pad 100A may be used to steer the drilling system.

In an embodiment of the present invention, by making the active gauge pad 100A under-gauged at least one circumferential location around the circumference of the active gauge pad 100A, a small gap between the active gauge pad 100A and the inner surface may be created that may be used to steer the drill bit 97. As such, in some embodiments of the present invention, the drilling system may be steered by use of contact surfaces on the bottomhole assembly 95 that may be within the profile cut by the cutters and/or without pushing the contact surfaces out beyond the cut profile.

FIG. 4C illustrates a further embodiment of the active gauge pad of the system depicted in FIG. 4A. In FIG. 4C an active gauge pad 100B may comprise a collar 105 coupled with an extendable element 107. The collar 105 may comprise a cylinder, disc, drill collar, gauge pad, a section of the bottomhole assembly 95, a section of the drill-string, a section of the drill pipe and or the like.

In an embodiment of the present invention, the extendable element 107 may be an element that may be controlled to change the circumferential profile of the collar 105. The extendable element 107 may be controlled/actuated by a controller 110. The controller 110 may comprise a motor, a hydraulic system and/or the like. In an embodiment of the present invention, the controller 110 may actuate the extendable element 107 to extend outward from the bottomhole assembly 95 so as to change dynamic interactions between the active gauge pad 100B and the inner surface of the borehole being drilled, resulting from radial/dynamic motion of the drilling system in the borehole during the drilling process.

In some embodiments of the present invention, the active gauge pad 100B may be configured to provide that when extended the active gauge pad 100B is disposed entirely with the cutting silhouette of the drill bit. In other embodiments of the present invention, a section or the entire extended/partially extended active gauge pad 100B may extend beyond the cutting silhouette of the drill bit. Merely by way of example, the active gauge 100B may be coupled with the drill-string to provide that the outer surface of the active gauge 100B in an extended position is of the order of 1-10 mm inside the cutting silhouette. In other aspects, and again merely by way of example, the active gauge 100B may be coupled with the drill-string to provide that at least a portion of the outer surface of the active gauge pad 100B when extended or partially extended extends in the range of tenths of millimeters to 10s or more millimeters beyond the cutting silhouettes.

In an embodiment of the present invention, the interactions between the active gauge pad 100B and the inner surface may be controlled by the positioning/extension of the extendable element 107 to provide for steering of the drilling system and directional drilling of the borehole being drilled by the drilling system. In certain aspects, the processor 70 may receive data regarding a desired drilling direction, data regarding the drilling process, data regarding the borehole, data regarding conditions in the borehole, seismic data, data regarding formations surrounding the borehole and/or the like and may operate the controller 110 to provide the positioning/extension of the extendable element 107 to steer the drilling system. In an embodiment of the present invention, the extendable element 107 may be extendable to adjust the dynamic interactions between the active gauge pad 100 and the inner surface of the borehole being drilled. This may require a simple passive extension of the extendable element 107 so that the active gauge pad 100 has a non-uniform shape around a central axis of the drilling system and/or the borehole, without having to apply a thrust or force on the inner surface.

In certain aspects, however, the extendable element 107 may be positioned, extended so as to exert a force on the inner surface. Merely by way of example, in certain embodiments, the extendable element 107 may exert a force of less than 1 kN on the inner surface to provide for both exertion of a reaction force from the inner surface on the drilling system and control of the dynamic interactions between the drilling system and the inner surface. Operating the extendable element 107 to provide for exertion of forces of less than 1 kN may be advantageous as such forces may not require large downhole power consumption/power sources, may reduce size and complexity of the controller 110 and/or the like.

In an embodiment of the present invention, the bottomhole assembly 95, the drill bit 97, the active gauge pad 100 and/or the like may be configured to have an unevenly distributed mass. The mass of the bottomhole assembly 95, the drill bit 97, the active gauge pad 100 and/or the like may vary circumferentially or the like to provide that the unsteady motion of the drilling system and/or the interaction between the drilling system and the inner surface of the borehole is not uniform. As such, the non-uniform weighting of the drilling system may provide for control of and/or steering of the drilling system. Merely by way of example, the drill collar which provides weight-on-bit, may be cylinder with a non-uniform weight distribution. In certain aspects, the cylindrical drill collar may be rotated to change the profile of the non-uniform weight/mass distribution in relation to the wellbore to provide a desired control of the drilling system and/or steering of the drilling system.

In some embodiments of the present invention, instead of or in combination with the gauge pads, drill collar and/or the like, the drill string may be shaped to provide for controlling unsteady interactions with the inner surface. For example, the bottomhole assembly 95 may be asymmetrically shaped, have asymmetrical compliance and/or the like. Furthermore, in accordance with some embodiments of the present invention the drill bit 97 may be asymmetrical, have an asymmetrical compliance, have non-uniform cutting properties and/or the like. Moreover, the drilling system may be configured to enhance the unsteady motion of the drilling system during the drilling process. Modeling, experimentation and/or the like may be used to design drilling systems with enhanced unsteady motion. Positioning of the cutters on the drill bit 97, cutter operation parameters may be used to provide for enhanced unsteady motion. In some embodiments of the present invention, the drilling system may incorporate a flexible/compliant coupling, a bent sub and/or the like (not shown) that may act to enhance unsteady interactions, enhance control of the drilling system from unsteady interactions and/or the like.

Figure 5:
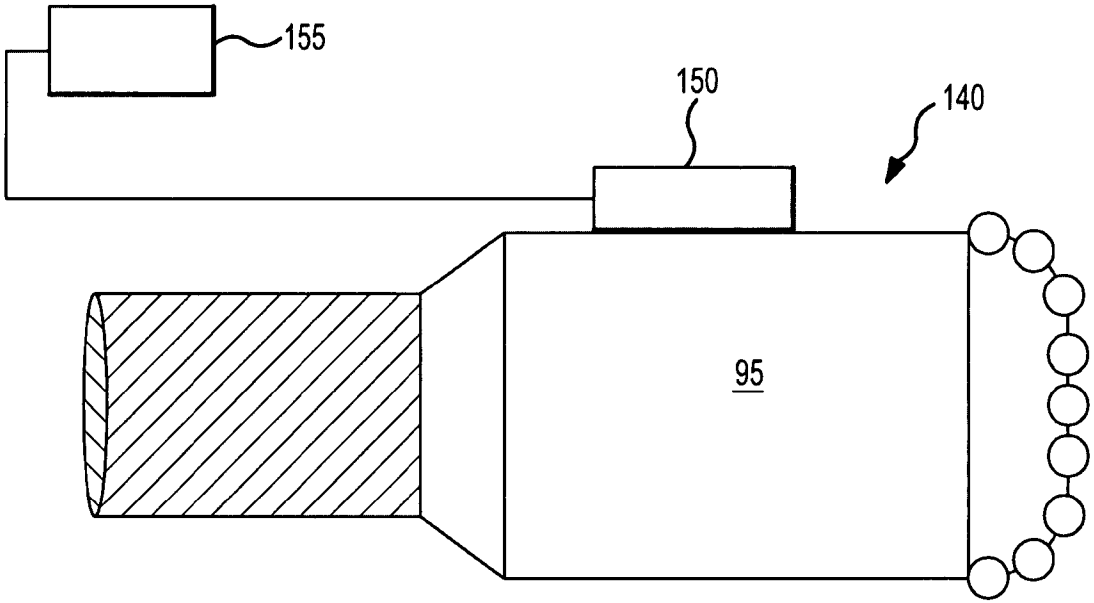
FIG. 5 provides a schematic-type illustration of a vibration application system for steering a drilling system to directionally drill a borehole, in accordance with an embodiment of the present invention.

FIG. 5 provides a schematic-type illustration of a repeated radial motion actuator system for steering a drilling system to directionally drill a borehole, in accordance with an embodiment of the present invention. In an embodiment of the present invention, a drilling system may comprise the drill-string 140—that may, in-turn, comprise the bottom hole assembly 95—and the drilling system may be configured for drilling a borehole through an earth formation.

In certain embodiments, a radial motion generator 150 may be attached to the drill-string 140. The radial motion generator 150 may be configured to generate radial motion of the bottomhole assembly 95 in the borehole; where radial motion may be any motion of the bottomhole assembly 95 directed away from the central axis of the borehole towards the inner-wall of the borehole. The radial motion generator 150 may comprise a mechanical vibrator, acoustic vibrator and/or the like that may produce repeated radial motion, such as vibrations, of the bottomhole assembly 95. The radial motion generator 150 may be tuned to the physical characteristics of the drill-string 140 and/or the bottomhole assembly 95 to provide for enhancing the radial motion produced.

In an embodiment of the present invention, interactions between the bottomhole assembly 95 and the inner surface of the borehole may be generated, enhanced, altered and/or the like by the radial motion generator 150. The radial motion generator 150 may provide for steering the drill-string 140 by creating, applying, changing and/or the like interactions between the bottomhole assembly and the inner surface of the borehole. By steering the drill-string 140, the borehole being drilled by the drill-string 140 maybe directionally drilled. A processor 155 may be used to control the radial motion generator 150 to generate interactions between the bottomhole assembly 95 and the inner surface so as to provide for steering of the drill-string 140 in a desired direction.

In some embodiments of the present invention, the radial motion generator 150 may be used in combination with other methods of creating non-uniform unsteady interactions between the drilling system and the inner surface of the borehole being drilled, such as described in this specification. In such embodiments, the radial motion generator 150 may provide for enhancing or dampening unsteady motion of the drill-string to enhance/damp the effect of the unsteady interaction controller and/or to control the unsteady interaction controller. In this way, the unsteady interaction controller may act as a controller/manager of the unsteady interaction controller and may itself be controlled by a processor to provide for controlling/steering the drilling system and/or enhancing damping the non-uniform unsteady motion interactions between the unsteady interaction controller and the inner surface of the borehole.

Figure 6A:
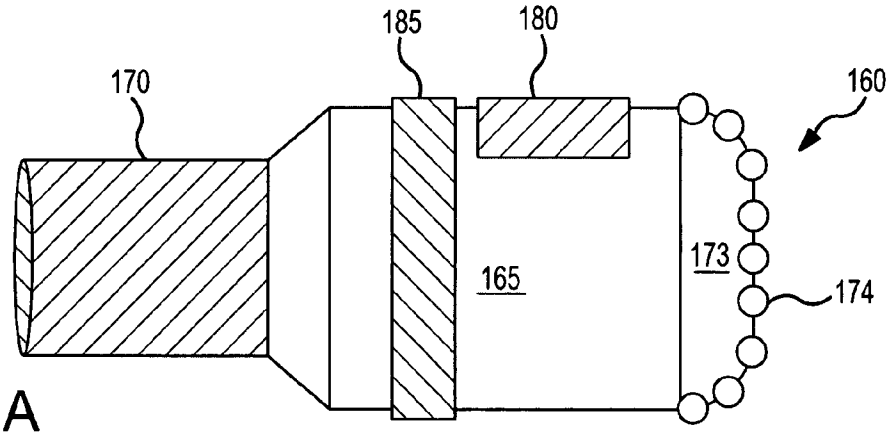
FIGS. 6A and 6B illustrate systems for selectively characterizing an inner surface of a borehole for steering a drilling assembly to directionally drill the borehole, in accordance with an embodiment of the present invention.
Figure 6B:
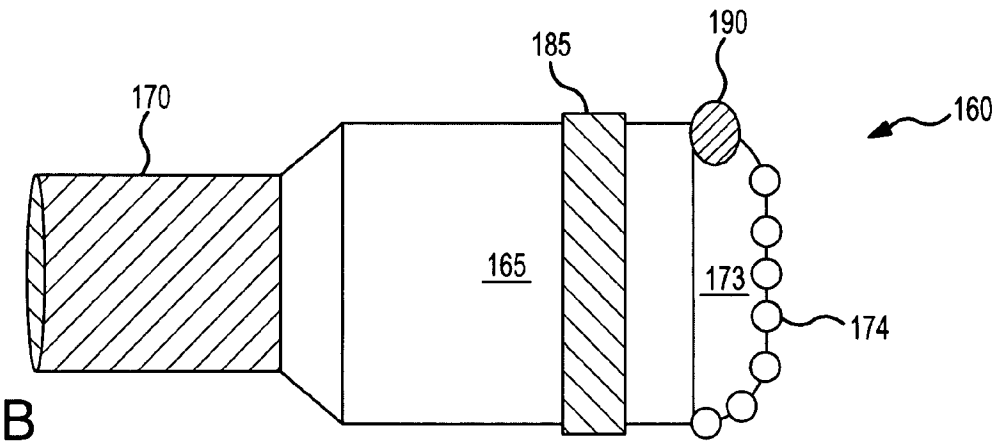

FIGS. 6A and 6B illustrate systems for selectively characterizing an inner surface of a borehole for steering a drilling assembly to directionally drill the borehole, in accordance with an embodiment of the present invention. In a drilling process, a drill-string 160 may be used to drill a borehole through an earth formation. The drill-string 160 may comprise a bottomhole assembly 165 and a coupler 170 that may couple the bottomhole assembly 165 with equipment at or proximal to a surface location. The bottomhole assembly may comprise a drill bit 173 that may comprise a plurality of teeth 174 for scrapping/crushing rock in the earth formation to create/extend the borehole being drilled.

During the drilling process, the inner surface of the borehole being drilled may be somewhat regular in shape and may be defined by an outer diameter of the drill bit 173. Generally, the inner surface is somewhat circular in shape. Properties of different portions of the earth formation may cause irregularities in the shape of the inner surface. In 6A, in accordance with an embodiment of the present invention, a shaping device 180 may interact with the inner surface to change/shape the inner surface. The shaping device 180 may comprise a fluid jet system for jetting a fluid onto the inner surface, a drill bit configured for laterally drilling into the inner surface, a scraper for scraping the inner surface and/or the like.

In an embodiment of the present invention, the shaping device 180 may be used to change the profile of the inner surface to provide for controlling interactions between the bottomhole assembly 165 and the inner surface. In certain aspects, a gauge pad 185 may be coupled with the bottomhole assembly 165 proximal to the drill bit 173 and may be configured to interact with the inner surface during drilling of the borehole by the drilling system. Where the inner surface is relatively uniform, random interactions between gauge pad 185 and the inner surface resulting from radial motion of the bottomhole assembly 165 during the drilling process may on average be uniform and may not affect the direction of drilling. In an embodiment of the present invention, the shaping device 180 may contour/shape the inner surface to control the interactions between the gauge pad 185 and the inner surface. In certain aspects of the present invention, the bottomhole assembly 165 may not comprise the gauge pad 185 and the interactions may be directly between the bottomhole assembly 165 and the inner surface.

In an embodiment of the present invention, by controlling the interactions between the gauge pad 185 and the inner surface the drilling system may be steered. In certain aspects, the shaping device 180 may be maintained geostationary during a steering procedure to provide for accurately selecting the region of the inner surface to be shaped by the shaping device 180 during the drilling process when the drill-string 140 and/or components of the drill-string 140 may be moving/rotating within the borehole.

The shaping device 180 may comprise water jets mounted between the gauge cutters and the gauge pads of the drill bit. The water jets or the like may be used to undercut the earth formation in front of the gauge pad to generate a gap between the inner surface and the gauge pad that may provide for vibrational steering of the drilling system in accordance with an embodiment of the present invention. In other embodiments, an electro-pulse system may be mounted in front of the gauge pads and may be used to soften up a section of the inner surface to allow the gauge pad to crush the material of this section to generate the gap to provide for vibrational steering of the drilling system in accordance with an embodiment of the present invention. In other embodiments, the electro-pulse system may be used to generate the gap directly.

In FIG. 6B the drill bit 173 may be configured to drill a borehole with a selectively non-uniform inner surface. In certain aspects, a tooth 190 of the drill bit 173 may be configured to be selectively activated to provide a contour on the inner surface. In other aspects, different techniques may be used to control the drill bit 173 to selectively shape the inner surface. By controlling the contours, shape of the inner surface of selectively placing grooves, indents or the like in the inner surface the interaction between the inner surface and the bottomhole assembly 165, resulting from radial motion of the bottomhole assembly 165 during drilling of the borehole, may be controlled and the direction of drilling may, as a result, also be controlled. In certain aspects, the drill bit 173 may comprise a mechanical cutter that may be deployed to preferentially cut one side of the inner surface.

Figure 7A:
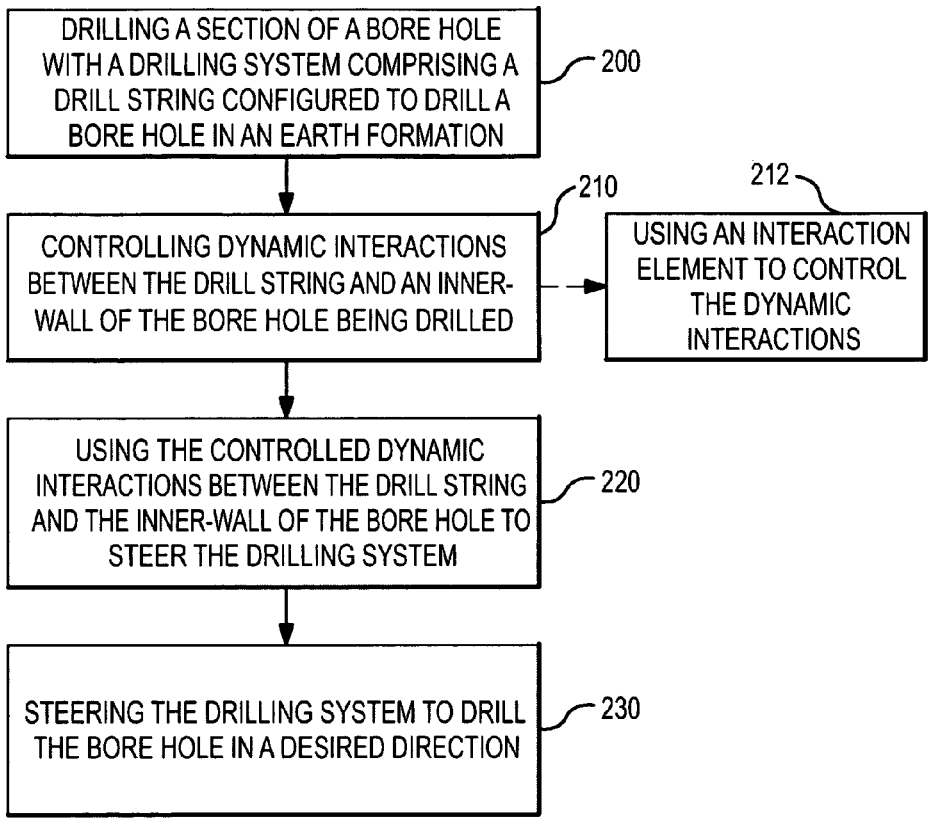
FIG. 7A is a flow-type schematic of a method for steering a drilling system to directionally drill a borehole, in accordance with an embodiment of the present invention.

FIG. 7A is a flow-type schematic of a method for steering a drilling system to directionally drill a borehole, in accordance with an embodiment of the present invention. In step 200, a drilling system may be used to drill a section of a borehole through an earth formation. The drilling system may comprise a drill-string attached to surface equipment or the like. The drill-string may itself comprise a bottomhole assembly comprising a drill bit for contacting the earth formation and drilling the section of the borehole through the earth formation. The bottomhole assembly may be linked to the surface equipment by drill pipe, casing, coiled tubing or the like. The drill bit may be powered by a top drive, rotating table, motor, drilling fluid and/or the like. During the drilling process the drill-string may undergo random motion in the borehole, which random motion may include radial vibrations that cause the drill-string to repeatedly contact an inner surface of the borehole during the drilling process. The interactions between the drill-string and the inner surface resulting from the radial vibrations may be most pronounced at the bottom of the borehole where interactions may occur between the bottomhole assembly and the inner surface.

In step 210, the vibrational-type interactions between the drill-string and the inner surface may be controlled. In certain embodiments of the present invention, the control of the dynamic interactions may occur at the bottom of the borehole. In some embodiments of the present invention, devices may be used at the bottom of the borehole to provide that the vibrational-type interactions of the bottomhole assembly and the inner surface are not uniform. In such embodiment, the step of controlling the vibrational-type interactions between the drill-string and the inner surface may comprise damping and/or enhancing at locations around the circumference of the inner surface the vibrational-type interactions between the bottomhole assembly and the inner surface. The damping and/or enhancing locations around the circumference of the inner surface may be maintained or varied as the borehole is drilled. In certain aspects, a plurality of devices may be used to create a non-uniform interaction between the bottomhole assembly and the inner surface.

In an embodiment of the present invention, an interaction element may be used in step 212 to provide for controlling the dynamic interactions. The interaction element may be an independent element such as a drill collar, gauge pad assembly, cylinder or the like that may be coupled with the drill-string, and in some aspects the bottomhole assembly, may be a section of the drill-string, such as a section of the bottomhole assembly, or the like. The interaction element may be configured to provide for uniform interaction between the interaction element and the interior surface of the borehole being drilled.

Generally, the borehole being drilled is a borehole in the earth formation with essentially a cylindrical inner surface. As such, in some aspects the interaction element may comprise an element with a profile that is non-uniform with respect to a center axis of the drill-string and/or the borehole. Merely by way of example, the interaction element may comprise an eccentric cylinder coupled with the bottomhole assembly; wherein as coupled with the bottomhole assembly a center axis of the eccentric cylinder is not coincident with a center axis of the bottomhole assembly. In another example, the interaction element may comprise a series of pads disposed around the bottomhole assembly and configured to contact cylindrical inner surface of the borehole during the drilling process, wherein at least one of the pads is configured to extend outward from the bottomhole assembly by a lesser or greater extent than the other pads.

In other embodiments, the interaction element may comprise an element with non-uniform compliance. Merely by way of example, the compliant element may comprise an element with certain compliance and a section of the element with an increased or decreased compliance relative to the certain compliance of the rest of the element, and be configured to provide that at least a part of the area of increased or decreased compliance and at least a part of the element with the certain compliance may each contact the cylindrical inner surface during the drilling process as a result of dynamic motion of the bottomhole assembly. In some embodiments of the present invention, an actuator may be used to change the characteristics of the interaction element, such as to actuate the interaction element from an element that interacts uniformly with the inner surface of the borehole to one that interacts in a non-uniform manner with the inner surface.

In certain embodiments of the present invention, the interaction element, whether being an element with a non-uniform profile, a non-uniform compliance and/or the like, may not be configured to exert a pressure on the inner surface or to thrust against the inner surface, but rather may be passive in nature and interact with the inner surface due to dynamic motion of the drill-string during the drilling process. For example, the interaction element may comprise an extendible element that is extended outward from the drill-string. In some aspects, forces may be applied by the extendible element on to the inner surface, but for simplicity and economic reasons the forces may only be small in nature, i.e. forces less than about 1 kN.

In some embodiments of the present invention, the interaction element may be configured so as not to extend beyond and/or be disposed entirely within a silhouette of the cutters of the drill bit. In other embodiments, the interaction element may have at least a portion that may extend beyond the silhouette of the drill bit. In certain aspects of the present invention, the interaction element may extend in the range of 1 mm to 10s of millimetres outside the silhouette of the drill bit and/or the cutters, with such an extension range providing for steering/controlling the drilling system.

In certain aspects of the present invention where the interaction element comprises one or more extendable elements, the one or more extendable elements may be extended so as not to extend beyond and/or be disposed entirely within a silhouette of the cutters and/or the drill bit. In other aspects, the one or more extendable elements may be extended to provide that at least a portion of the one or more extendable elements extends beyond the silhouette of the cutters and/or the drill bit. Steering of the drilling system may be provided in certain embodiments of the present invention by extending the one or more extendable elements extend in the range of 1-10 mm beyond the silhouette of the cutters and/or the drill bit. In such embodiments, unlike directional drilling systems using reaction forces, thrust against the borehole wall for steering, only a small amount of power and/or minimal downhole equipment may be used/needed to actuate and/or maintain the extendable elements in the desired extension beyond the silhouette of the cutters and/or the drill bit.

In some aspects using a plurality of devices, the combination of devices may be configured to provide for non-uniform interactions between the drill-string and the inner surface circumferentially around the drill-string and, in such configurations, coupling of the plurality of the devices with the drill-string in a manner in which the effect of one device on the dynamic interactions cancels out the effect of another of the devices may be avoided. Devices that may be used to control the dynamic interactions may include, among other devices: gauge pads, drill collars, stabilizers and/or the like that may be non-concentrically arranged on the bottomhole assembly; gauge pads, drill collars, stabilizers and/or the like that may be configured to have non-uniform circumferential compressibility; devices for changing the profile/shape/contour of the inner surface; drill bits configured to drill a borehole with an irregular inner surface; and/or the like.

In step 220, the drilling system may be steered by controlling the vibrational-type interactions between the drill-string and the inner surface of the borehole. In an embodiment of the present invention, the devices used to control the dynamic interactions between the drill-string and the inner surface of the borehole may be selectively positioned in the borehole to provide that the dynamic interactions steer the drilling system. In drilling systems in which at least a portion of the drill-string rotates during the drilling process the devices may be held geostationary in the borehole to provide for the steering. In certain embodiments of the present invention, the devices used to control the dynamic interactions between the drill-string and the inner surface of the borehole may be selectively positioned on the drill-string prior to drilling a section of the borehole to provide the desired steering of the drilling system. In certain aspects, the devices used to control the dynamic interactions between the drill-string and the inner surface of the borehole may be re-positioned prior to drilling a further section of the borehole. In embodiments where an actuator, such as a cam or the like, is used to change the properties of the device used to control the dynamic interactions between the drill-string and the inner surface of the borehole, the cam rather than the device used to control the dynamic interactions may be selectively positioned and/or repositioned during the drilling process.

In some embodiments of the present invention, means for controlling the position in the borehole, orientation in the borehole, location and/or orientation on the drill-string of the device used to control the dynamic interactions between the drill-string and the inner surface of the borehole and/or a device for actuating the device used to control the dynamic interactions between the drill-string and the inner surface of the borehole, such as a cam or the like, may be used to move the device used to control the dynamic interactions between the drill-string and the inner surface of the borehole during the drilling process.

In step 230, the drilling system is steered to drill the borehole in a desired direction. In an embodiment of the present invention, a desired direction for the section of the borehole to be drilled may be determined and the device used to control the dynamic interactions may be positioned in the borehole and/or on the drill-string so as to steer the drilling system to drill the section of the borehole in the desired direction. In certain aspects, a processor may control the position, orientation and/or the like of the device used to control the dynamic interactions in the borehole and/or on the drill-string to provide that the section of the borehole to be drilled is drilled in the desired direction. In certain embodiments, data from sensors disposed on the drill-string, data from sensors disposed in the borehole, data from sensors disposed in the earth formation proximal to the borehole, seismic data and/or the like may processed by the processor to determine a position orientation of the device used to control the dynamic interactions for the desired drilling direction.

Figure 7B:
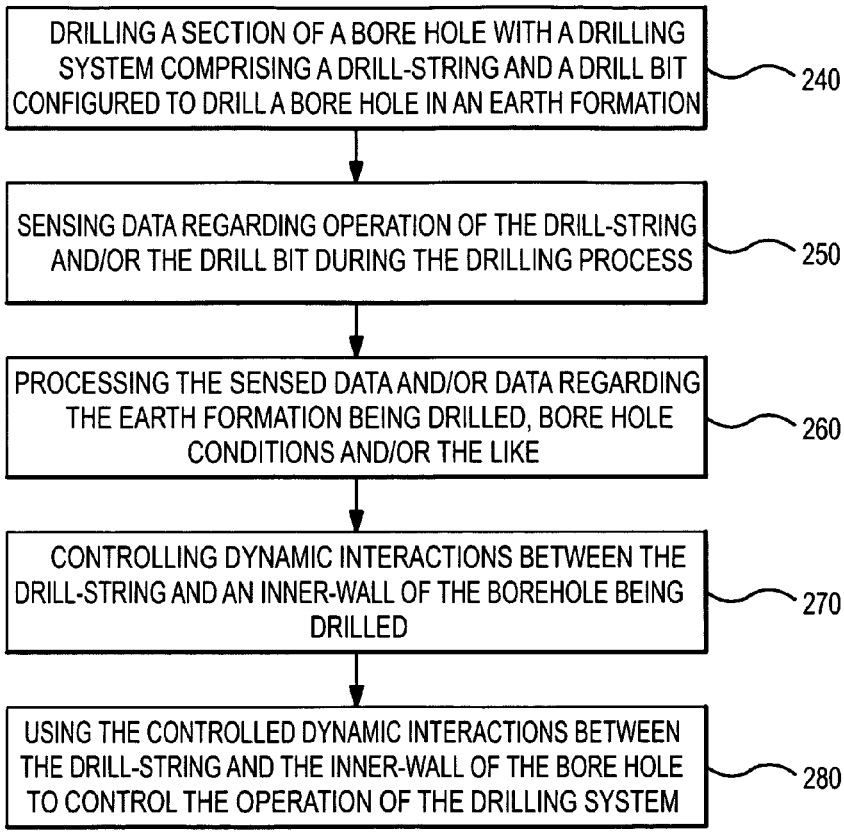
FIG. 7B is a flow-type schematic of a method for controlling a drilling system for drilling a borehole in an earth formation, in accordance with an embodiment of the present invention.

FIG. 7B is a flow-type schematic of a method for controlling a drilling system for drilling a borehole in an earth formation, in accordance with an embodiment of the present invention. In step 240, a drilling system comprising a drill-string and a drill bit configured to drill a borehole in an earth formation may be used to drill a section of a borehole. In step 250, data regarding operation of the drill-string and/or the drill bit during the drilling process may be sensed. The data may include such things as weight-on-bit, rotation speed of the drilling system, hook load, torque and/or the like. Additionally, data may be gathered from the borehole, the surface equipment, the formation surrounding the borehole and/or the like and data may be input regarding intervention/drilling processes being or about to be implemented in the drilling process. For example, pressures and/or temperatures in the borehole and the formation may be determined, seismic data may be acquired from the borehole and/or the formation, drilling fluid properties may be identified and/or the like.

In step 260, the sensed data regarding the drilling system and/or data regarding the earth formation and/or conditions in the borehole being drilled and/or the like may be processed. The processing may be determinative/probabilistic in nature and may identify current and/or potential future states of the drilling system. For example, conditions and/or potential drilling system conditions such as inefficient performance of the drill bit, stalling of the drill bit and/or the like may be identified.

In some embodiments of the present invention, a processor receiving sensed data may be used to manage the controlling of the unsteady-motion-interactions between the drilling system and the inner surface of the borehole. For example, magnetometers, gravimeters, accelerometers, gyroscopic systems and/or the like may determine amplitude, frequency, velocity, acceleration and/or the like of the drilling system to provide for understanding of any unsteady motion of the drilling system. The data from the sensors may be sent to the processor for processing and values for the unsteady motion of the drilling system may be displayed, used in a control system for controlling the unsteady interactions of the drillstring, processed with other data from the earth formation, wellbore and/or the like to provide for management of the control system for controlling the unsteady interactions of the drill-string and/or the like. Merely by way of example, communication of the sensed data to the processor may be made via a telemetry system, a fiber optic, a wired drill pipe, wired coiled tubing, wireless communication and/or the like.

In step 270, vibrational-type interactions between the drill-string and an inner surface of the borehole being drilled may be controlled. Control of the interactions between the drill-string and an inner surface of the borehole may be provided by changing/manipulating/altering contact characteristics of a section of the bottomhole assembly, a section of the drill-string, the cutters of the drill bit, a profile of the inner surface of the borehole and/or the like. The contact characteristics may be characteristics associated with an outer-surface of the section of the bottomhole assembly, the section of the drill-string, the cutters of the drill bit and/or the like that may contact the inner surface of the borehole during the drilling process. The contact characteristics may comprise a profile/shape of the outer-surface (i.e. may comprise an eccentric shape of the outer-surface around a central axis of the drilling system, bottomhole assembly, drill bit and/or the like, may comprise sections of the outer-surface that may be over-gauge and/or under-gauge) may comprise a non-uniform compliance around the outer-surface and/or the like.

In step 280, the controlled vibrational-type interactions between the drill-string and the inner surface of the borehole may be used to control the operation/functionality of the drilling system. For example, when whirring of the drill bit of the drilling system may be detected or predicted, the vibrational-type interactions between the drill-string and the inner surface of the borehole may be controlled to eliminate, reduce and/or prevent the whirring. In an embodiment of the present invention, the functionality of the drilling system may be determined from the processed data and may be altered by controlling the interactions between the drill-string and an inner surface of the borehole. In this way, embodiments of the present invention may provide new systems and methods for controlling operation of a drilling system.

Figure 8:
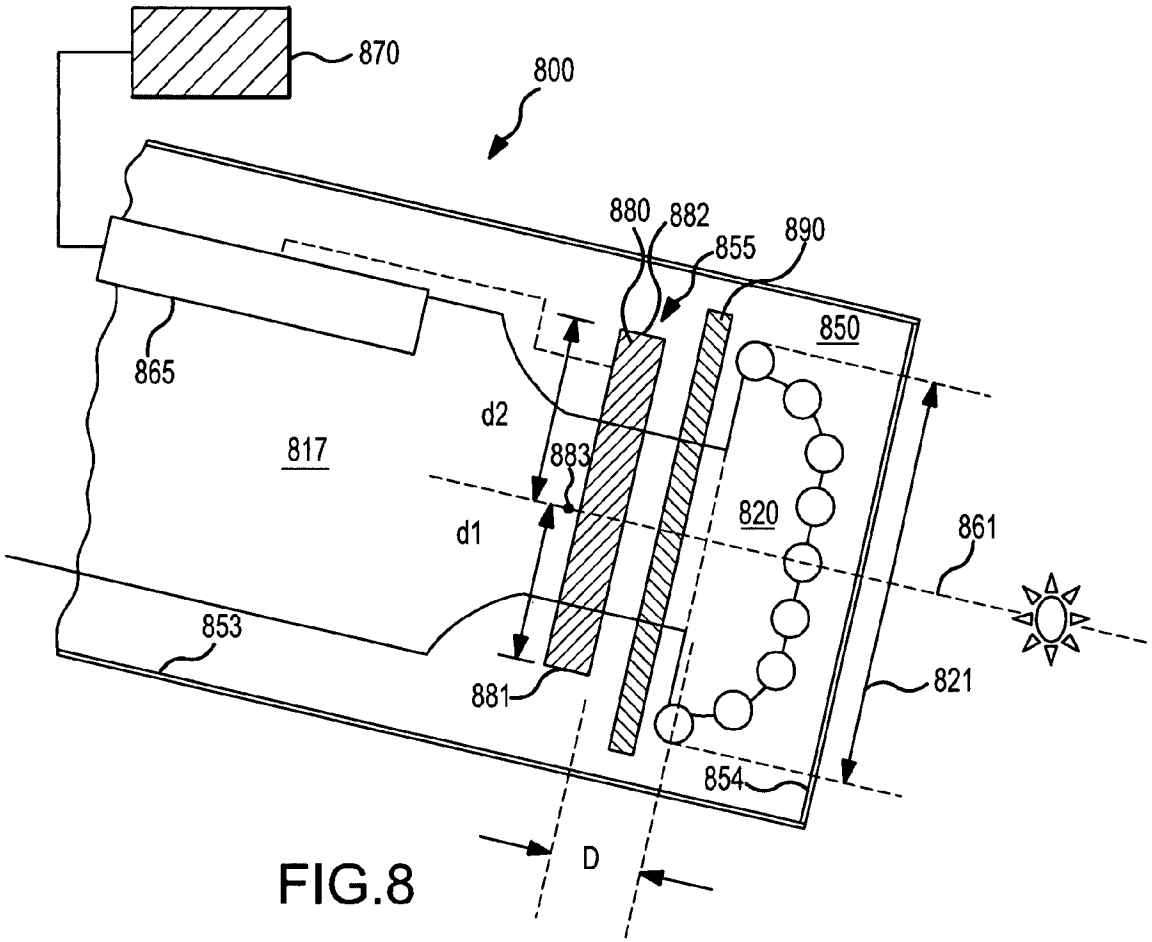
FIG. 8 is a schematic-type illustration of a system for steering a drilling system for drilling a borehole, in accordance with an embodiment of the present invention.

Embodiments of the present invention provide methods and systems for controlling or harvesting stochastic interactions or movements associated with a drilling system. For example, these interactions can occur between a drill bit or bottomhole assembly and a borehole wall. Embodiments disclosed herein are well suited for use in harnessing such vibrational or stochastic interactions, for the purpose of directing or affecting the trajectory of a drilling system. For example, a stochastic control element or interaction element can operate to harvest the vibrations of the drill bit itself so as to effect a change in trajectory of a drilling system. FIG. 8 is a schematic-type illustration of a system for steering a drilling system for drilling a borehole, in accordance with an embodiment of the present invention. In FIG. 8, the drilling system for drilling the borehole may comprise the bottomhole assembly 817, which may in-turn comprise the drill bit 820. The drilling system may provide for drilling a borehole 850 having an inner-wall 853 and a drilling-face 854.

During the drilling process, the drill bit 820 may contact the drilling-face 854 and crush/displace rock at the drilling-face 854. In an embodiment of the present invention, a means for controlling intermittent contact, such as an interaction element 880, may be coupled with the drilling system, for example via the bottomhole assembly 817. The interaction element 880 may be a tube, cylinder, framework or the like. The interaction element 880 may have an outer-surface 855.

Hence, a system for controlling a drilling system can include the drilling system 800 in combination with the interaction element 880. The drilling system may have a drill-string coupled with a bottomhole assembly 817, and the bottomhole assembly may include a drill bit 820. The interaction element 880 can be coupled with the drilling system 800, and can be configured to intermittently contact a surface of, and remain rotationally stationary with respect to, the borehole 850 during the drilling. As shown here, the interaction element can be disposed proximal to the drill bit 820 at a distance of D. In some cases, distance D is about 3 meters or less. Optionally, the interaction element 880 can be disposed proximal to the drill bit 820 at a distance within a range from about 0.5 meters to about 2.5 meters. In some cases, distance D is within a range from about 1.0 meter to about 2.0 meters. In some cases, distance D is within a range from about 0.1 meters to about 1.0 meters. In some cases, distance D is within a range from about 0.05 meters to about 0.5 meters. Relatedly, distance D can be within a range from about 0.7 meters to about 1.3 meters. Similarly, distance D can be within a range from about 0.9 meters to about 1.1 meters. In some cases, the interaction element 880 can be disposed proximal to the drill bit 820 at a distance of less than about 2.0 meters. In some cases, the interaction element 880 can be disposed proximal to the drill bit 820 at a distance of less than about 1.0 meter. Optionally, the interaction element 880 can be disposed proximal to the drill bit 820 at a distance of less than about 0.5 meters.

As depicted in FIG. 8, the drilling system 800 may be coupled with a gauge pad assembly 890. The gauge pad assembly 890 can be configured to rotate with respect to the borehole during the drilling. As further discussed herein the interaction element 880 can be non-uniformly circumferentially compliant.

In certain aspects where the interaction element 880 comprises a tube, cylinder and/or the like the outer-surface 855 may comprise the outer-surface of the tube/cylinder and/or any pads, projections and/or the like coupled with the outer surface of the tube/cylinder. The interaction element 880 may have roughened sections, coatings, projections on its outer surface to provide for increased frictional contact between an outer-surface of the interaction element 880 and the inner-wall 853. The interaction element 880 may comprise pads configured for contacting the inner-wall 853.

In certain aspects, the drilling system may include a gauge pad system or assembly 890 in addition to the interaction element 880. In aspects where the interaction element 880 may comprise a series of elements, such as pads or the like, the outer-surface 855 may be defined by the outer-surfaces of each of the elements (pads) of the interaction element 880. In an embodiment of the invention, the interaction element 880 may be configured with the bottomhole assembly 817 to provide that the outer-surface 855 engages, contacts, interacts and/or the like with the inner-wall 853 and/or the drilling-face 854 during the drilling process as a result of the dynamic motion of the bottomhole assembly 817, or the drill bit 820, or both. The design/profile/compliance of the outer-surface 855 and/or the disposition of the outer-surface 855 relative to a cutting silhouette of the drill bit 820 may provide for controlling the dynamic interaction between the outer-surface 855 and the inner-wall 853 and/or the drilling-face 854, or for controlling the dynamic interaction between the drill bit 820 and the inner-wall 853 and/or the drilling-face 854.

The drilling system or interaction element may comprise a structure that provides a lateral movement of the interaction element 880 relative to the drill bit 820, where the lateral movement is a movement that is, at least in part directed, towards a center axis 861 of the bottomhole assembly 817. In certain aspects, the interaction element 880 may itself be configured to be laterally compliant and may be coupled to the bottomhole assembly 817 and/or may be a section of the bottomhole assembly 817.

In one embodiment of the present invention, the interaction element 880 may not be uniformly-circumferentially compliant. In such an embodiment, one or more sections of the interaction element 880 disposed around the circumference of the interaction element 880 may be more laterally compliant than other sections of the interaction element 880.

As observed previously, during the drilling process the bottomhole assembly 817 or one or more sections of the bottomhole assembly 817 may undergo dynamic interactions with the inner-wall 853 and/or the drilling-face 854. In an embodiment of the present invention, the interaction element 880 may be configured to provide that dynamic motion of the bottomhole assembly 817 produces dynamic interactions between the interaction element 880 and the inner-wall 853 and/or the drilling-face 854 during the drilling process. In different aspects of the present invention, different relative outer-circumferences as between the interaction element 880 and the bottomhole assembly 817 and/or the drill bit 820 may provide for different dynamic interactions between the interaction element 880 and the inner-wall 853 and/or the drilling-face 854. Modeling, theoretical analysis, experimentation and/or the like may be used to select differences in the relative outer-circumference between the interaction element 880 and the bottomhole assembly 817 and/or the drill bit 820 for a particular drilling process to produce the wanted/desired dynamic interaction.

In an embodiment of the present invention in which the lateral compliance varies circumferentially around the interaction element 880, the dynamic interaction between the interaction element 880 and the inner-wall 853 and/or the drilling-face 854 may not be uniform circumferentially around the interaction element 880. Merely by way of example, the interaction element 880 may comprise an area of decreased compliance and an area of increased compliance. In certain aspects, dynamic interactions between the interaction element 880 and the inner-wall 853 and/or the drilling-face 854 above a section of the interaction element 880 having increased lateral compliance, i.e., the area of increased compliance, may be damped in comparison with dynamic interactions between the interaction element 880 and the inner-wall 853 and/or the drilling-face 854 above a section of the interaction element 880 having decreased lateral compliance, i.e., the area of decreased compliance.

In some embodiments of the present invention, the interaction element 880 may be configured to provide that the interaction element 880 is coupled with the bottomhole assembly to provide that the interaction element 880 is disposed entirely within a cutting silhouette 21 of the drill bit 20, the cutting silhouette 821 comprising the edge-to-edge cutting profile of the drill bit 820 (e.g. defined by perimeter of side cutters). In other embodiments of the present invention, the interaction element 880, a section of the interaction element 880, the outer-surface 855 and/or a section of the outer-surface 855 may extend beyond the cutting silhouette 821. Merely by way of example, the interaction element 880 may be coupled with the bottomhole assembly 817 to provide that the outer outer-surface 855 is of the order of 1-10s of millimeters inside the cutting silhouette 821. In other aspects, and again merely by way of example, the interaction element 880 may be coupled with the bottomhole assembly 817 to provide that at least a portion of the outer-surface 855 extends in the range up to 10s of or more millimeters beyond the cutting silhouette 821.

In embodiments of the present invention, any non-uniform circumferential compliance of the interaction element 880 may provide for steering/controlling the drilling system. The amount of differential compliance in the interaction element 880 and/or the profile of the non-uniform compliance of the interaction element 880 may be selected to provide the desired steering response and/or control of the drill bit 820. Steering response and/or drill bit response of a drilling system for a compliance differential and/or a circumferential compliance profile may be determined theoretically, modeled, deduced from experimentation, analyzed from previous drilling processes and/or the like.

In embodiments of the present invention configured for use with a drilling system that does not involve the use of a rotating drill bit or where a housing of the drilling system, e.g., a housing of the bottomhole assembly is non-rotational, the interaction element 880 may be coupled with the drilling system or the housing. In such an embodiment, the drilling system may be disposed in the borehole with the area of increased compliance disposed at a specific orientation to the drill bit 820 to provide for drilling of the borehole 850 in the direction of the area of increased compliance. To change the direction of drilling by the drilling system, the position of the area of increased compliance may be changed.

In some embodiments, a positioning device 865—which may comprise a motor, a hydraulic actuator and/or the like—may be used to rotate/align the interaction element 880 to provide for drilling of the borehole 850 by the drilling system in a desired direction. The positioning device 865 may be in communication with a processor 870. The processor 870 may control the positioning device 865 to provide for desired directional drilling. The processor 870 may determine a position of the interaction element 880 in the borehole 850 from manual intervention, an end point objective for the borehole, a desired drilling trajectory, a desired drill bit response, a desired drill bit interaction with the earth formation, seismic data, input from sensors (not shown)—which may provide data regarding the earth formation, conditions in the borehole 850, drilling data (such as weight on bit, drilling speed and/or the like) vibrational data of the drilling system, dynamic interaction data and/or the like—data regarding the location/orientation of the drill bit in the earth formation, data regarding the trajectory/direction of the borehole and/or the like.

The processor 870 may be coupled with a display (not shown) to display the orientation/direction/location of the borehole 850, the drilling system, the drill bit 820, the interaction element 880, the drilling speed, the drilling trajectory and/or the like. The display may be remote from the drilling location and supplied with data via a connection such as an Internet connection, web connection, telecommunication connection and/or the like, and may provide for remote operation of the drilling process. Data from the processor 870 may be stored in a memory and/or communicated to other processors and/or systems associated with the drilling process.

In another embodiment of the present invention, the steering/drill bit functionality control system may be configured for use with a rotary-type drilling system in which the drill bit 820 may be rotated during the drilling process and, as such, the drill bit 820 and/or the bottomhole assembly 817 may rotate in the borehole 850. In such an embodiment, the interaction element 880 may be configured so that motion of the interaction element 880 is independent or at least partially independent of the rotational motion of the drill bit 820 and/or the bottomhole assembly 817. As such, the interaction element 880 may be held geostationary in the borehole 50 during the drilling process.

In certain aspects, the interaction element 880 may be a passive system comprising one or more cylinders disposed around the drilling system. The one or more cylinders may in some instances be disposed around the bottomhole assembly 817 of the drilling system. The one or more cylinders may be configured to rotate independently of the drilling system. In such aspects, the one or more cylinders may be configured to provide that friction between the one or more cylinders and the formation may fix, prevent rotational motion of, the one or more cylinders relative to the rotating drilling system. In certain aspects of the present invention, the one or more cylinders may be locked to the bottomhole assembly when there is no weight-on-bit, and hence no drilling of the borehole, and then oriented and unlocked from the bottomhole assembly when weight-on-bit is applied and drilling commences; the friction between the one or more cylinders and the inner surface maintaining the orientation of the one or more cylinders. In some aspects of the present invention, the one or more cylinders may be coupled with the bottomhole assembly 817 by a bearing or the like.

In some embodiments of the present invention, the positioning of the one or more cylinders may be provided, as in a non-rotational drilling system, by the positioning device 865, which may rotate the one or more cylinders to change the location of an active area of the cylinder in the borehole 850 to change the drilling direction and/or the functioning of the drill bit 820. For example, the interaction element 880 may comprise a cylinder and maybe rotated around the bottomhole assembly 817 to change a location of the area of increased compliance and/or the area of decreased compliance to change the drilling direction of the drilling system resulting from the dynamic interaction between the interaction element 880 and the inner-wall 853. Alternatively, an active control may be used to maintain a desired orientation/position of the interaction element 880 with respect to the bottomhole assembly 817 during the drilling process. In addition this type of device could be used in a motor assembly to replace the bent sub. This could bring benefits in terms of tripping the assembly into the hole through tubing and completion restrictions and when drilling straight in rotary mode.

Figure 8A:
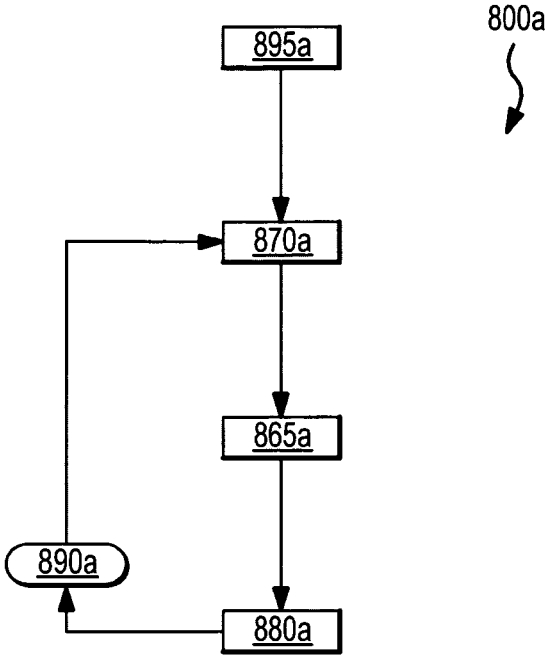
FIGS. 8A-8M illustrate aspects of a drilling control system, in accordance with embodiments of the present invention.

FIG. 8A illustrates aspects of a drilling trajectory control system 800*a* according to embodiments of the present invention. Control system 800*a* includes a processor 870*a* coupled with or in operative association with a display 895*a*, an actuator or positioning device 865*a*, and a sensor 890*a* such as a trajectory sensor. As shown here, actuator 865*a* is coupled with a means for controlling intermittent contact such as an interaction element 880*a*, which in turn is coupled with sensor 890*a*.

Figure 8B:
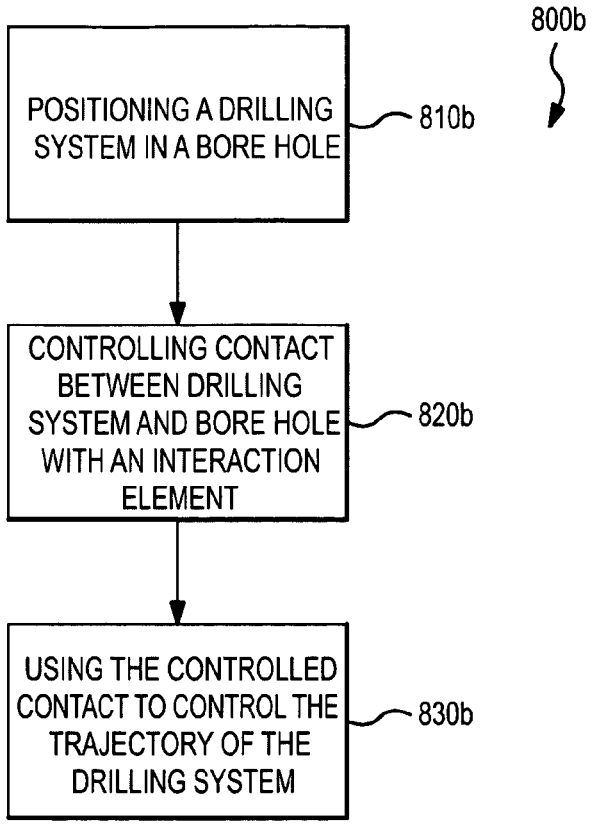

FIG. 8B depicts aspects of a drilling trajectory control method 800*b* according to embodiments of the present invention. Control method 800*b* includes positioning the drilling system in the borehole as indicated in step 810*b*. The drilling system can include a drill-string coupled with a bottomhole assembly, and the bottomhole assembly can include a drill bit. The method further includes controlling intermittent contact occurring between the drilling system and a surface of the borehole with an interaction element that is coupled with the drilling system, as indicated in step 820*b*. Additionally, the method includes using the controlled intermittent contact between the drilling system and the surface of the borehole to control the trajectory of the drilling system in the borehole, as illustrated in step 830*b*.

In some embodiments, the interaction element is configured to intermittently contact a surface of, and remain rotationally stationary with respect to, the borehole during the drilling, and is disposed proximal to the drill bit at a distance of about 3 meters or less. In some embodiments, the interaction element is configured to intermittently contact a surface of, and remain rotationally stationary with respect to, the borehole during the drilling, and the interaction element defines a first peripheral edge disposed within the cutting silhouette and a second peripheral edge opposing the first peripheral edge, and a first distance between the cutting silhouette central point and the first peripheral edge is different from a second distance between the cutting silhouette central point and the second peripheral edge. In some embodiments, a greater difference between the first distance and the second distance corresponds to a greater magnitude of change in the trajectory of the drilling system.

Figure 8C:
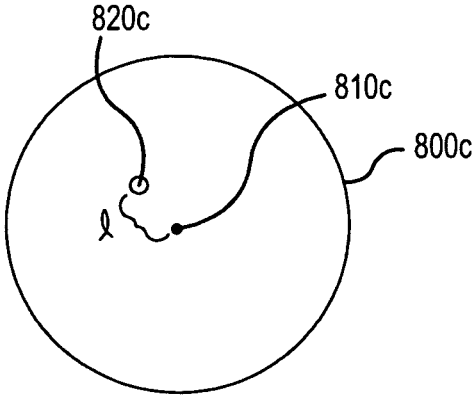
Figure 8D:
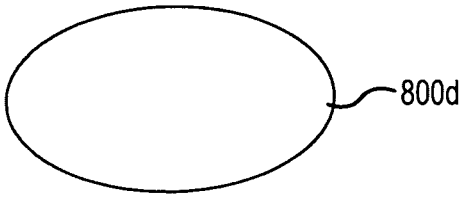

FIG. 8C illustrates aspects of a drilling trajectory control system according to embodiments of the present invention. A drilling trajectory control system can include an interaction element that defines an interaction silhouette 800*c* having central point 810*c*. As shown here, interaction silhouette 800*c* has a circular shape. The central point 810*c* is laterally offset by a distance 1 from a central axis 820*c* of a bottomhole assembly. According to FIG. 8D, an interaction element may have an interaction silhouette 800*d* having an elliptical, or noncircular shape.

Figure 8E:
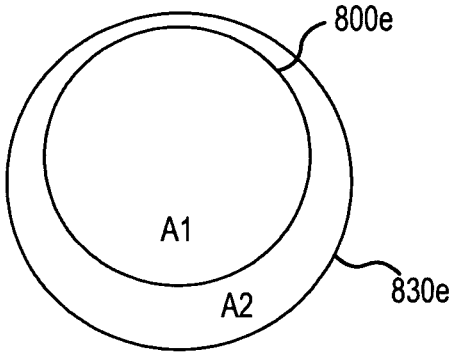
Figure 8F:
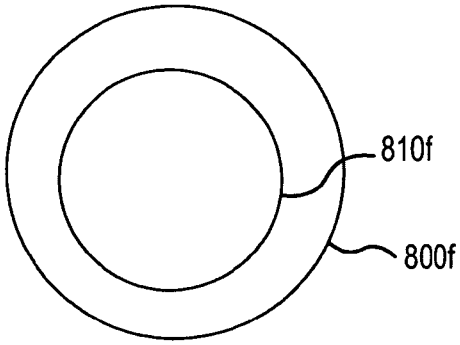
Figure 8G:
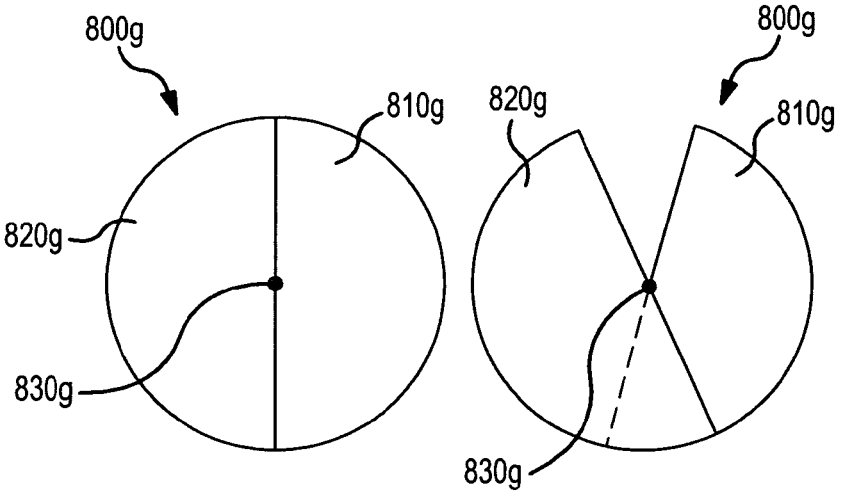

As shown in FIG. 8E, an interaction element can define an interaction silhouette 800*e* having a first area A1, and a drill bit can define a cutting silhouette 830*e* having a second area A2. In some cases, area A1 is different from area A2. In some cases, area A1 is equivalent to area A2. As shown in FIG. 8F, an interaction element can be adjustable between a first configuration that presents a first interaction silhouette 800*f* and a second configuration that presents a second interaction silhouette 810*f*. For example, as depicted in FIG. 8G, an interaction element 800*g* can include first and second eclipsing blades 810, 820, which rotate about a common pivot 830, whereby in a first configuration the interaction element presents a larger interaction silhouette, and in a second configuration the interaction element presents a smaller interaction silhouette. In some cases, a first interaction silhouette can confer minimal or no change in trajectory for a drilling bit, whereas a second interaction silhouette can confirm a substantial or desired change in trajectory for the drilling bit. An interaction element can include any of a variety of structural elements, including a cylinder, a disk, and the like. In some instances, an interaction element includes a gauge ring. For example, a drilling system may include a gauge ring coupled with a bottomhole assembly. In some instances, an interaction element includes a cam that adjusts the interaction element from a first configuration presenting a first interaction silhouette to a second configuration presenting a second interaction silhouette.

Figure 8H:
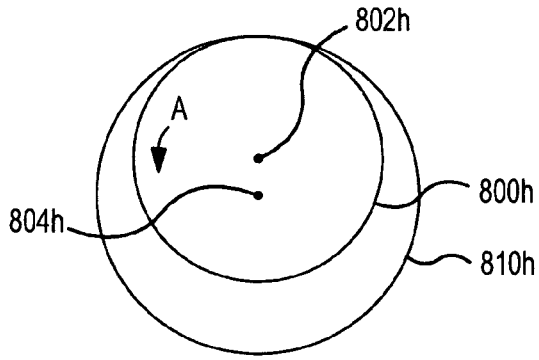
Figure 8I:
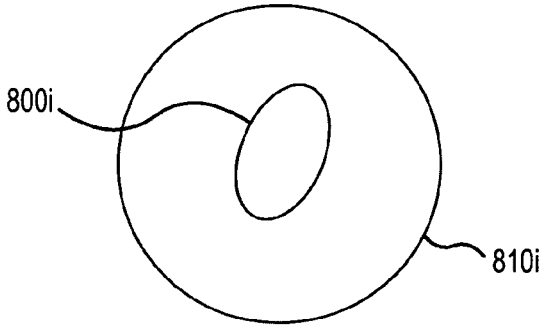

FIG. 8H illustrates aspects of a trajectory control system according to embodiments of the present invention. An interaction element can define an interaction silhouette 800*h* and a drill bit can define a cutting silhouette 810*h*. As shown here, interaction silhouette has a central point 802*h*, and can pivot about an interaction element pivot or axis 804*h*. The interaction element axis 804*h* can be coincident with a central axis of a borehole assembly. A radial adjustment or rotation of the interaction element about axis 804*h*, exemplified by arrow A, can cause a corresponding drilling trajectory adjustment of the drilling system. As shown in FIG. 8I, an interaction silhouette 800*i* can be noncircular and a cutting silhouette 810*i* can be circular.

Figure 8J:
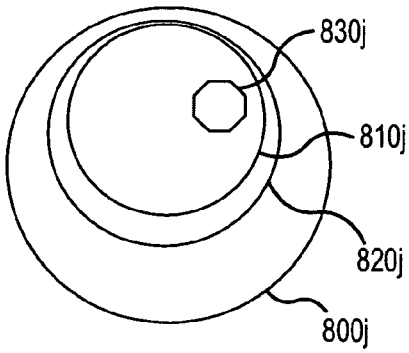

FIG. 8J illustrates aspects of a trajectory control system according to embodiments of the present invention. A drill bit can define a cutting silhouette 800*j*, and an interaction element can be adjustable, such that in a first configuration the interaction element defines a first interaction silhouette 810*j*, and in a second configuration the interaction element defines a second interaction silhouette 820*j*. As shown here, a trajectory control system may include a cam 830*j* that facilitates adjustment of the interaction element between the first configuration and the second configuration.

Figure 8K:
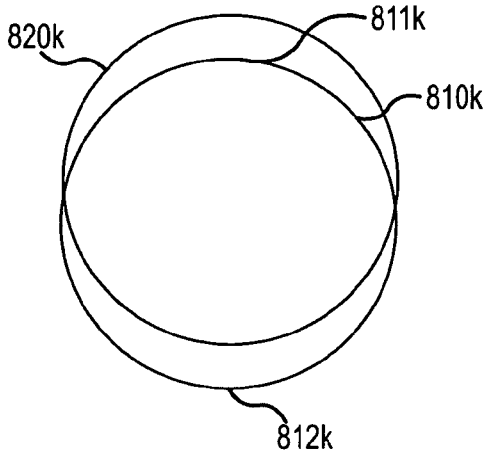
Figure 8L:
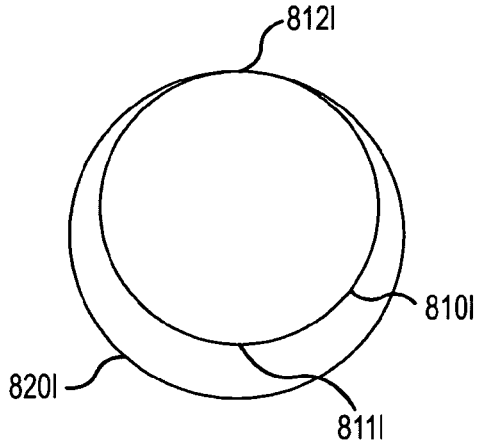
Figure 8M:
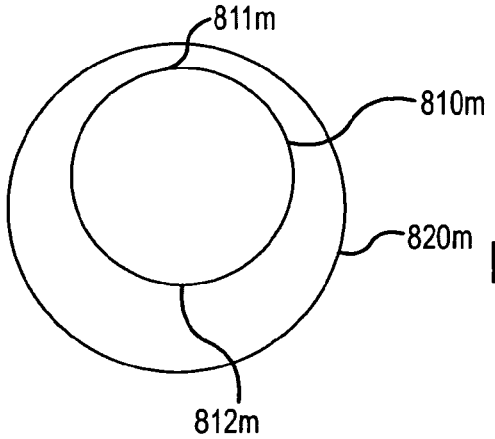

With returning reference to FIG. 8, according to some embodiments an interaction element 880 can define a first peripheral edge 881 disposed within the cutting silhouette and a second peripheral edge 882 opposing the first peripheral edge. A first distance d1 between the cutting silhouette central point 883 or axis 861 and the first peripheral edge 881 is different from a second distance d2 between the cutting silhouette central point 883 or axis 861 and the second peripheral edge 882. As shown in FIG. 8K, a first edge 811*k* of the interaction element 810*k* can be disposed within the cutting silhouette 820*k*, and the second edge 812*k* of the interaction element 810*k* can be disposed beyond the cutting silhouette 820*k*. As shown in FIG. 8L, the first edge 811*l* of the interaction element 810*l* can be disposed within the cutting silhouette 820*l*, and the second edge 812*l* of the interaction element 810*l* can be disposed at the cutting silhouette 820*l*. As shown in FIG. 8M, the first edge 811*m* of the interaction element 810*m* can be disposed within the cutting silhouette 820*m*, and the second edge 812*m* of the interaction element 810*m* can be disposed within the cutting silhouette 820*m*.

Again, with returning reference to FIG. 8, a difference between the first and second distances d1, d2 can be within a range from about 1 mm to about 10 mm. In some instances, a difference between the first and second distances d1, d2 can be within a range from about 0.5 mm to about 20 mm. Optionally, a difference between the first and second distances d1, d2 can be within a range from about 0 cm to about 10 cm. Relatedly, a difference between the first and second distances d1, d2 can be within a range from about 1 cm to about 2 cm. In some cases, a difference between the first and second distances d1, d2 can be less than about 1 cm. In some cases, a difference between the first and second distances d1, d2 can be about 1 mm. According to some embodiments, the first and second edges of the interaction element can be disposed within the cutting silhouette, and a difference between the first and second distances can be about 1 mm. According to some embodiments, an interaction element is adjustable to a second configuration where the first and second distances d1, d2 are equal.

A gauge pad can be used as an interaction element. A gauge pad may be a part of the bottomhole assembly, for example on or coupled with the drill bit, that contacts the borehole and inhibits or prevents the drill bit from wobbling around. In some instances, the gauge pad can be about the same diameter as the borehole being drilled. According to some embodiments of the present invention, it is possible to hold a gauge pad stationary during the drilling procedure so that differences in its profile (e.g. weight, shape, and the like) can influence/bias the stochastic motion of the drill bit in a given direction. In some cases, there are three or four elements on the sides of the drill bit that are referred to as the gauge pads.

Figure 9A:
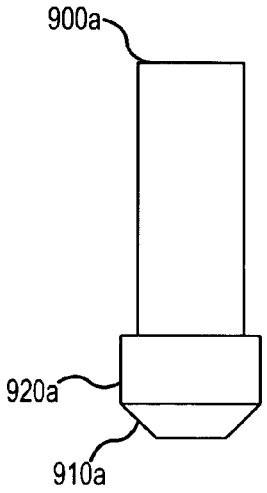
FIGS. 9A-9C are schematic-type illustrations of a system for steering a drilling system for drilling a borehole, in accordance with embodiments of the present invention.
Figure 9B:
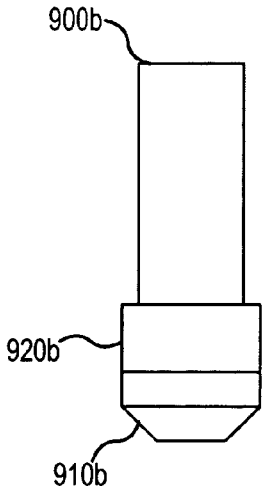
Figure 9C:
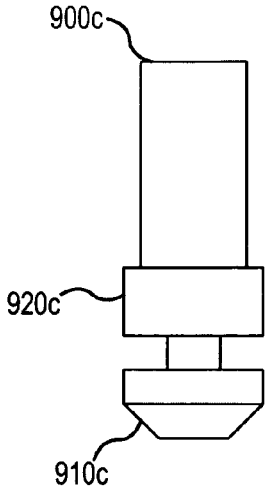

A device for inhibiting cutting on one side of the bit, such as a gauge pad or interaction element, can be deployed at the bit, on the flanks of the bit for example, or just above the bit. As depicted in FIG. 9A, a drilling system 900*a* may include a drill bit 910*a*, and may be coupled with a gauge pad 920*a* or interaction element. As shown here, the gauge pad 920*a* is in, at, or coupled with the bit 910*a* in a "pad-in-bit" configuration. As depicted in FIG. 9B, a drilling system 900*b* may include a drill bit 910*b*, and may be coupled with a gauge pad 920*b* or interaction element. As shown here, the gauge pad 920*b* is in, on, or coupled with the flank of the bit 910*b* in a "pad-in-flank-of-bit" configuration. As depicted in FIG. 9C, a drilling system 900*c* may include a drill bit 910*c*, and may be coupled with a gauge pad 920*c* or interaction element. As shown here, the gauge pad 920*c* is above or behind the bit, in a "pad-behind-bit" configuration.

As noted previously, randomly directed forces acting on the rotating bit can be harnessed to steer or control the trajectory of the bit. Side cutters of a drill bit can be temporarily, and synchronously with the rotation, prevented or inhibited from cutting the wellbore. By applying an inhibition to cutting in a particular direction fixed in the frame of the earth, the bit, subject to random forces, will tend, on average, to preferentially drill in the opposite direction. This directed inhibition to cutting can be achieved by a gauge pad or interaction element disposed in a "pad-in-bit", "pad-in-flank-of-bit", or "pad-behind-bit" configuration. The gauge pad or interaction element can be rotationally fixed relative to the earth so as not to rotate with the bit, and may be thick enough to inhibit side cutting whenever the random forces acting on the bit caused the bit to move towards the pad or interaction element.

With such a device, steering in a particular direction can be achieved by orienting the gauge pad, interaction element, or cutting inhibition means in a direction roughly fixed in the frame of the earth. So oriented, the bit can progressively drill in or toward the opposite direction. The fixed (e.g. rotationally stationary) orientation of the cutting inhibition device can be achieved in any number of ways using, for example, a downhole geostationary mechanism, or a means of orienting the cutting inhibition device from surface. The cutting inhibition device or interaction element can be deployed at the bit, on the flanks of the bit for example, or just above the bit. In some instances, the inhibiting device or interaction element is disposed within about a meter of the bit. The interaction element may comprise pads, or a complete ring with a desired profile to inhibit cutting over a limited azimuthal range, or it may comprise a means of temporarily suppressing side cutting during the bit rotation.

Figure 10:
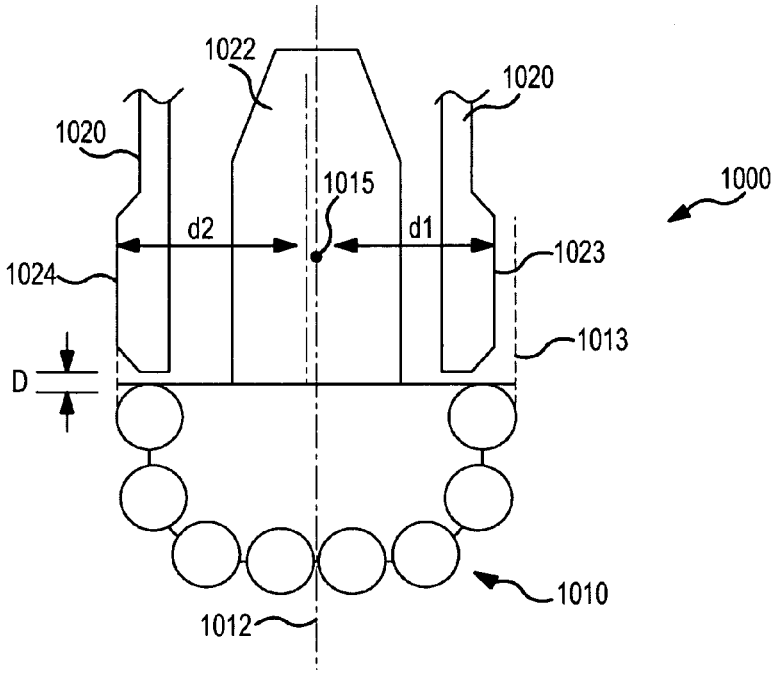
FIG. 10 illustrates aspects of a drilling control system, in accordance with an embodiment of the present invention.

As illustrated in FIG. 10, a drilling system 1000 may include a drill bit 1010 having or defining a central longitudinal axis 1012. Drilling system 1000 may be coupled with a gauge pad assembly or interaction element 1020 having or defining a central longitudinal axis 1022. As depicted here, the central longitudinal axis 1022 of the gauge pad assembly 1020 is laterally offset from the central longitudinal axis 1012 of the drill bit 1010. According to some embodiments the interaction element 1020 can define a first peripheral edge 1023 disposed within the cutting silhouette 1013 and a second peripheral edge 1024 opposing the first peripheral edge. A first distance d1 between the cutting silhouette central point 1015 or axis 1012 and the first peripheral edge 1023 is different from a second distance d2 between the cutting silhouette central point 1023 or axis 1012 and the second peripheral edge 1024. The interaction element 1020 can be disposed proximal to the drill bit 1010 at a distance of D. In some cases, distance D is about 3 meters or less.

With an understanding of the concept of embodiments of the present invention, there are many factors/characteristics/properties of the drillstring/bottomhole assembly that may be designed to enhance/cause the biasing of stochastic motion and/or the inhibiting of side-cutting by the drill bit. Merely by way of example, in some aspects of the present invention the lateral stiffness between the cutting structure and the gauge pad structure may be designed to enhance/cause the biasing of stochastic motion and/or the inhibiting of side-cutting by the drill bit. For example, in some embodiments the lateral stiffness between the cutting structure and the gauge pad structure should be less than 16 kN/mm. In other aspects, the lateral stiffness between the cutting structure and the gauge pad structure should be between 12 and 16 kN/mm. In further aspects, the lateral stiffness between the cutting structure and the gauge pad structure should be between 8 and 12 kN/mm. In yet further aspects, the lateral stiffness between the cutting structure and the gauge pad structure should be between 4 and 8 kN/mm. In still further aspects, the lateral stiffness between the cutting structure and the gauge pad structure should be between 4 and 6 kN/mm. In other aspects, the lateral stiffness between the cutting structure and the gauge pad structure should be less than 4 kN/mm.

By way of further examples of drillstring/bottomhole assembly design, the gauge pad assembly and the cutting structure may have different relative stiffnesses. In some aspects of the present invention, the gauge pad assembly is configured to be more stiff than the cutting structure. In other aspects, the cutting structure should is more stiff than the gauge pad assembly. The difference in relative stiffness serving to generate an interaction between the two components that may cause/enhance control stochastic motion of the drilling system.

In other examples of drilling system design in accordance with aspects of the present invention, the gauge pads on the shield side are wider than on the non-shield side so as to tolerate the side force. In some embodiments, the interaction element may comprise a gauge pad assembly where the gauge pads in the assembly are designed so that at least one of the gauge pads has different pad area, pad length or pad width to at least one of the other gauge pads in the gauge pad assembly. In certain aspects the gauge pads on opposite sides of the gauge pad assembly may have on opposite sides may have different areas, lengths or widths. Consistent with the concept of the present invention, these differences in design of one or more of the gauge pads in the gauge pad assembly provide an eccentricity in the gauge pad system that may be used to bias stochastic motion and/or inhibit side-cutting of the drill bit.

In aspects of the present invention, a flex joint may be positioned near to the interaction element/gauge pad system that may provide for enhancing the biasing effect of the interaction element/gauge pad system. In some aspects, a stabilizer may be used in combination with the flex joint to provide for enhanced interaction between the effect of the interaction element/gauge pad system and the flex joint. In some aspects of the present invention, the flex joint may be positioned within about 20 feet (7 meters) of the interaction element/gauge pad system. In other aspects, the flex joint may be positioned in a range of about 5-10 feet (2-3 meters) of the interaction element/gauge pad system. In other aspects, the flex joint may be positioned less than 5 feet (2 meters) from the interaction element/gauge pad system. The flex joint may be useful where eccentricity of the interaction element/gauge pad system is small such as where the eccentricity is generated by design of the shape of gauge pads in the gauge pad system. In some embodiments of the present invention, he flex joint may have a nonuniform lateral stiffness that may be used to maximise steering and/or minimize walk.

The invention has now been described in detail for the purposes of clarity and understanding. However, it will be appreciated that certain changes and modifications may be practiced within the scope of the appended claims. Moreover, in the foregoing description, for the purposes of illustration, various methods and/or procedures were described in a particular order. It should be appreciated that in alternate embodiments, the methods and/or procedures may be performed in an order different than that described.

What is claimed is:

1. A system for controlling a drilling system configured for drilling a borehole in an earth formation, comprising:

the drilling system, wherein the drilling system comprises a drill-string coupled with a bottomhole assembly, and the bottomhole assembly comprises a drill bit;

an interaction element rotatably coupled with the drilling system, wherein:

the interaction comprises a gauge pad assembly disposed circumferentially around the drilling system;

the gauge pad assembly defines an interaction silhouette having a first area, and the drill bit defines a cutting silhouette having a second area, such that at least one of a size or location of the first area is different from a size or location of the second area;

the gauge pad assembly is held geostationary in the borehole during operation of the drilling system; and the gauge pad assembly is disposed proximal to the drill bit at a distance of about 3 meters or less; and a controller configured to rotate the interaction element around the drilling system to change the interaction silhouette.

2. The system of claim 1, wherein the interaction element is disposed proximal to the drill bit at a distance within a range from about 0.5 meters to about 2.5 meters.

3. The system of claim 1, wherein the interaction element is disposed proximal to the drill bit at a distance within a range from about 1.0 meter to about 2.0 meters.

4. The system of claim 1, wherein the interaction element is disposed proximal to the drill bit at a distance within a range from about 0.1 meters to about 1.0 meters.

5. The system of claim 1, wherein the interaction element is disposed proximal to the drill bit at a distance within a range from about 0.05 meters to about 0.5 meters.

6. The system of claim 1, wherein the interaction element is disposed proximal to the drill bit at a distance within a range from about 0.7 meters to about 1.3 meters.

7. The system of claim 1, wherein the interaction element is disposed proximal to the drill bit at a distance within a range from about 0.9 meters to about 1.1 meters.

8. The system of claim 1, wherein the interaction element is disposed proximal to the drill bit at a distance of less than about 2.0 meters.

9. The system of claim 1, wherein the interaction element is disposed proximal to the drill bit at a distance of less than about 1.0 meter.

10. The system of claim 1, wherein the interaction element is disposed proximal to the drill bit at a distance of less than about 0.5 meters.

11. The system of claim 1, wherein the interaction element is nonuniformly circumferentially compliant.

12. The system of claim 1, wherein the interaction silhouette has a circular shape and a central point, and wherein the central point is laterally offset from a central axis of the bottomhole assembly.

13. The system of claim 1, wherein the interaction silhouette has an elliptical shape.

14. The system of claim 1, wherein the interaction silhouette has a noncircular shape.

15. The system of claim 1, wherein the interaction element is adjustable between a first configuration that presents a first interaction silhouette and a second configuration that presents a second interaction silhouette.

16. The system of claim 1, wherein the gauge pad assembly comprises a cylinder.

17. The system of claim 1, wherein the interaction element comprises a cam mechanism that adjusts the interaction element from a first configuration presenting a first interaction silhouette to a second configuration presenting a second interaction silhouette.

18. A method of controlling a trajectory of a drilling system in a borehole in an earth formation, comprising:

positioning the drilling system in the borehole, the drilling system comprising a drill-string coupled with a bottomhole assembly, and the bottomhole assembly comprising a drill bit;

controlling intermittent contact occurring between the drilling system and a surface of the borehole with an interaction element that is rotatably coupled with the drilling system;

using the controlled intermittent contact between the drilling system and the surface of the borehole to control the trajectory of the drilling system in the borehole, wherein:

the interaction element comprises a gauge pad assembly that is disposed circumferentially around the drilling system and configured to intermittently contact a surface of the borehole during drilling;

the gauge pad assembly defines an interaction silhouette having a first area, and the drill bit defines a cutting silhouette having a second area, such that at least one of a size and a location of the first area is different from a size or location of the second area;

the gauge pad assembly is held geostationary in the borehole during operation of the drilling system; and the gauge pad assembly is disposed proximal to the drill bit at a distance of about 3 meters or less; and rotating the interaction element around the drilling system to change the interaction silhouette.

19. The method of claim 18, wherein the interaction element is disposed proximal to the drill bit at a distance within a range from about 0.9 meters to about 1.1 meters.

20. The method of claim 18, wherein the interaction element is disposed proximal to the drill bit at a distance of less than about 2.0 meters.

21. The method of claim 18, wherein the interaction element is disposed proximal to the drill bit at a distance of less than about 1.0 meter.

22. The method of claim 18, wherein the interaction element is disposed proximal to the drill bit at a distance of less than about 0.5 meter.

23. The method of claim 18, wherein the step of controlling intermittent contact occurring between the drilling system and a surface of the borehole with the interaction element comprises using the interaction element to inhibit stochastic motion of the drilling system in one or more lateral directions.

* * * * *